US007850161B2

(12) United States Patent
Fukatsu et al.

(10) Patent No.: US 7,850,161 B2
(45) Date of Patent: Dec. 14, 2010

(54) SHEET PROCESSING APPARATUS AND IMAGE FORMING APPARATUS

(75) Inventors: Masayoshi Fukatsu, Suntoh-gun (JP); Atsushi Ogata, Mishima (JP); Junichi Sekiyama, Tokyo (JP); Hiroharu Tsuji, Numazu (JP); Kimihiko Nagano, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 658 days.

(21) Appl. No.: 11/693,058

(22) Filed: Mar. 29, 2007

(65) Prior Publication Data

US 2007/0231036 A1 Oct. 4, 2007

(30) Foreign Application Priority Data

Mar. 31, 2006 (JP) ..... 2006-096436
Mar. 31, 2006 (JP) ..... 2006-096438

(51) Int. Cl.
*B65H 33/04* (2006.01)
*B65H 39/00* (2006.01)

(52) U.S. Cl. ..... 270/58.12; 270/58.07; 270/58.08; 270/58.09; 270/58.11; 270/58.16; 270/58.17; 270/58.27

(58) Field of Classification Search ..... 270/58.07, 270/58.08, 58.09, 58.11, 58.12, 58.16, 58.17, 270/58.27
See application file for complete search history.

(56) References Cited

U.S. PATENT DOCUMENTS 6,352,253 B1 * 3/2002 Hayakawa et al. ..... 270/58.12
6,722,646 B2 4/2004 Sekiyama et al.
6,942,206 B2 9/2005 Kuwata et al.
6,997,456 B2 * 2/2006 Fukatsu et al. ..... 271/306
2004/0022567 A1 2/2004 Fukatsu et al.
2005/0121848 A1 * 6/2005 Kodama et al. ..... 270/58.12
2006/0082047 A1 4/2006 Fukatsu et al. ..... 271/220
2006/0239735 A1 10/2006 Ogata et al.

FOREIGN PATENT DOCUMENTS

JP 2004-059314 A 2/2004

OTHER PUBLICATIONS

Office Action dated Jan. 22, 2010, in Chinese Patent Application No. 200710091466.7.

* cited by examiner

*Primary Examiner*—Gene Crawford
*Assistant Examiner*—Yolanda Cumbess
(74) *Attorney, Agent, or Firm*—Fitzpatrick, Cella, Harper & Scinto

(57) ABSTRACT

A pressing member pressed against a sheet stack portion can be moved to both a retracting portion where alignment of the sheet by the aligning portion is not prevented and a pressing position where the aligned sheet S1 is pressed against the sheet stack portion. Moreover, a regulation member for regulating upward movement of the end of the aligned sheet in a conveyance direction can be moved in association with movement of the pressing member to both a retracting portion where alignment of the sheet S1 by the aligning portion is not prevented and a regulating position where upward movement of the end of the aligned sheet S1 in a conveyance direction is regulated.

23 Claims, 25 Drawing Sheets

SHEET PROCESSING APPARATUS AND IMAGE FORMING APPARATUS

BACKGROUND OF THE INVENTION

1. Field of the Invention

The present invention relates to a sheet processing apparatus and an image forming apparatus having the same, particularly to a sheet processing apparatus for aligning sheets and binding them without causing misalignment of the rear ends.

2. Description of the Related Art

Conventionally, some image forming apparatuses such as copying machines are provided with a sheet processing apparatus which sequentially takes image-formed sheets into the apparatus and binds them in order to, for example, reduce the time required in binding the imaged-formed sheets.

For example, as disclosed in Japanese Patent Application Laid-Open No. 2004-59314, some of the sheet processing apparatuses carry the sheets by an intermediate roller to an intermediate sheet stack portion on which the sheet ends are aligned, and thereafter bind them using a binding unit such as a stapler.

FIG. 21 shows the configuration of this conventional sheet processing apparatus, in which an image-formed sheet S is conveyed to an intermediate sheet stack portion 101 by an intermediate roller 102. Then, the sheet S stacked on the intermediate sheet stack portion 101 is returned in the opposite direction to the conveyance direction by a not-illustrated return unit and contacts with an alignment reference wall 104 and the rear end in a conveyance direction is aligned.

However, if the precedent sheet S stacked on the intermediate sheet stack portion 101 is lifted above the nip line of the intermediate roller 102 when a sheet is conveyed, a subsequent sheet may collide with the precedent sheet S and disturb the alignment or cause a jam.

Therefore, conventionally, a rear-end regulation member 103 is used to prevent the rear end of the precedent sheet S stacked on the intermediate sheet stack portion 101 from moving (being lifted) by the rear-end regulation member 103. The rear-end regulation member 103 is rotatably set to the downstream of the nip position of the intermediate roller 102 and is energized in the direction opposite to the sheet conveyance direction shown by the arrow B so as to limit the position of the rear end of the precedent sheet S by the lower end and prevent the lift of the precedent sheet S.

Then, the rear end of the precedent sheet S is located below the nip line of the intermediate roller 102 before the rear-end regulation member 103 is pressed by the front end of a subsequent sheet to rotate. Thereby, when the rear-end regulation member 103 rotates, the front end of the subsequent sheet is conveyed up to the downstream side of the rear end of the precedent sheet S and the front end of the subsequent sheet does not collide with the rear end of the precedent sheet S.

Moreover, a conventional sheet processing apparatus is provided with a pressing unit 170 which presses the top of a precedent sheet S1 aligned in its end after the sheet is conveyed to the intermediate sheet stack portion 101 as shown in FIG. 22. Then, by pressing the precedent sheet S1 by the pressing unit 170, extrusion of the precedent sheet S1 by a subsequent sheet S2 is prevented.

In this case, the pressing unit 170 is lowered by the action of a solenoid 173. Then, when the pressing unit 170 moves downward, an elastic body 172 on the lower portion presses the top of the precedent sheet S1 to prevent extrusion of the precedent sheet S1 by a subsequent sheet S2.

When aligning the end of the sheet S1 conveyed to the intermediate sheet stack portion 101, the pressing unit 170 can rise to a retracting position by the action of the solenoid 173. Therefore, the pressing unit 170 does not interrupt alignment.

However, in the case of the conventional sheet processing apparatus and image forming apparatus, when curl is large, for example, at the traveling-directional upstream side of a sheet in the conveyance direction, the rear end of the precedent sheet S1 may be stacked so as to lean to the alignment reference wall 104.

In this case, because the rear-end regulation member 103 is not energized in the direction in which a sheet is pressed against the intermediate sheet stack portion 101, the precedent sheet S1 enters the gap between the alignment reference wall 104 and the rear-end regulation member 103. Then, when the precedent sheet S1 enters the gap between the alignment reference wall 104 and the rear-end regulation member 103, the rear-end regulation member 103 cannot regulate the rear end of the precedent sheet S1. As a result, a subsequent sheet collides with the rear end of the precedent sheet S1 and there is a problem that the sheet is damaged or jam occurs.

Moreover, in the case of the alignment reference wall 104, a portion 104*a* close to stapler frontage is lowered so as to lure a sheet conveyed by the intermediate roller 102 into the frontage of the stapler 142 located at a position lower than the nip of the intermediate roller 102. Therefore, this problem is significant particularly at a position close to the stapler frontage.

Therefore, to solve the above problem, a pressing member 171 for preventing lift of the rear end of a sheet may be set to the pressing unit 170 as shown in, for example, FIG. 25. Moreover, when the pressing unit 170 moves downward, the rear end of the precedent sheet S1 is pressed to the intermediate sheet stack portion 101 by the pressing member 171.

However, when the underside 171*a* of the rear-end regulation member 171 completely presses the rear end of the precedent sheet S1 in order to press the rear end of the precedent sheet S1 to the intermediate sheet stack portion 101, the sheet rear end is buckled before pressing the curl of a sheet as shown in FIG. 25. Thereby, the rear end of the sheet leans to the first alignment reference wall 104. When bringing the sheet to a binding unit, misalignment of the rear end of a sheet bundle occurs.

SUMMARY OF THE INVENTION

Therefore, the present invention is made in view of the above situation and its object is to provide a sheet processing apparatus capable of binding sheet bundles without misalignment of rear ends of the sheets, and an image forming apparatus.

The present invention is provided with a sheet stack portion onto which sheet to be processed are conveyed, sheet conveying unit for conveying sheets to the sheet stack portion, aligning unit for aligning the sheets conveyed to the sheet stack portion, pressing member capable of moving to both a retracting portion where alignment of the sheet by the aligning portion is not prevented and pressing position where the aligned sheet is pressed against the sheet stack portion, and a regulation member capable of moving to both a retracting portion where alignment of the sheet by the aligning portion is not prevented and a regulating position where upward movement of the end of the aligned sheet in a conveyance direction is regulated. The regulation surface of the regulation member at the regulating position is located above the pressure-contact face of the pressing member to be pressed against the aligned sheet, and the regulation member operates in association with movement of the pressing member.

Regulating movement of the aligned sheets to the upside of the end of the aligned sheets in a conveyance direction by the regulation member in association with movement of the pressing member to a pressing position and thereby, it is possible to bind sheet bundles without misalignment of rear end.

Further features of the present invention will become apparent from the following description of exemplary embodiments with reference to the attached drawings.

DESCRIPTION OF THE EMBODIMENTS

Exemplary embodiment for carrying out the present invention is described below by referring to the accompanying drawings.

Figure 1:
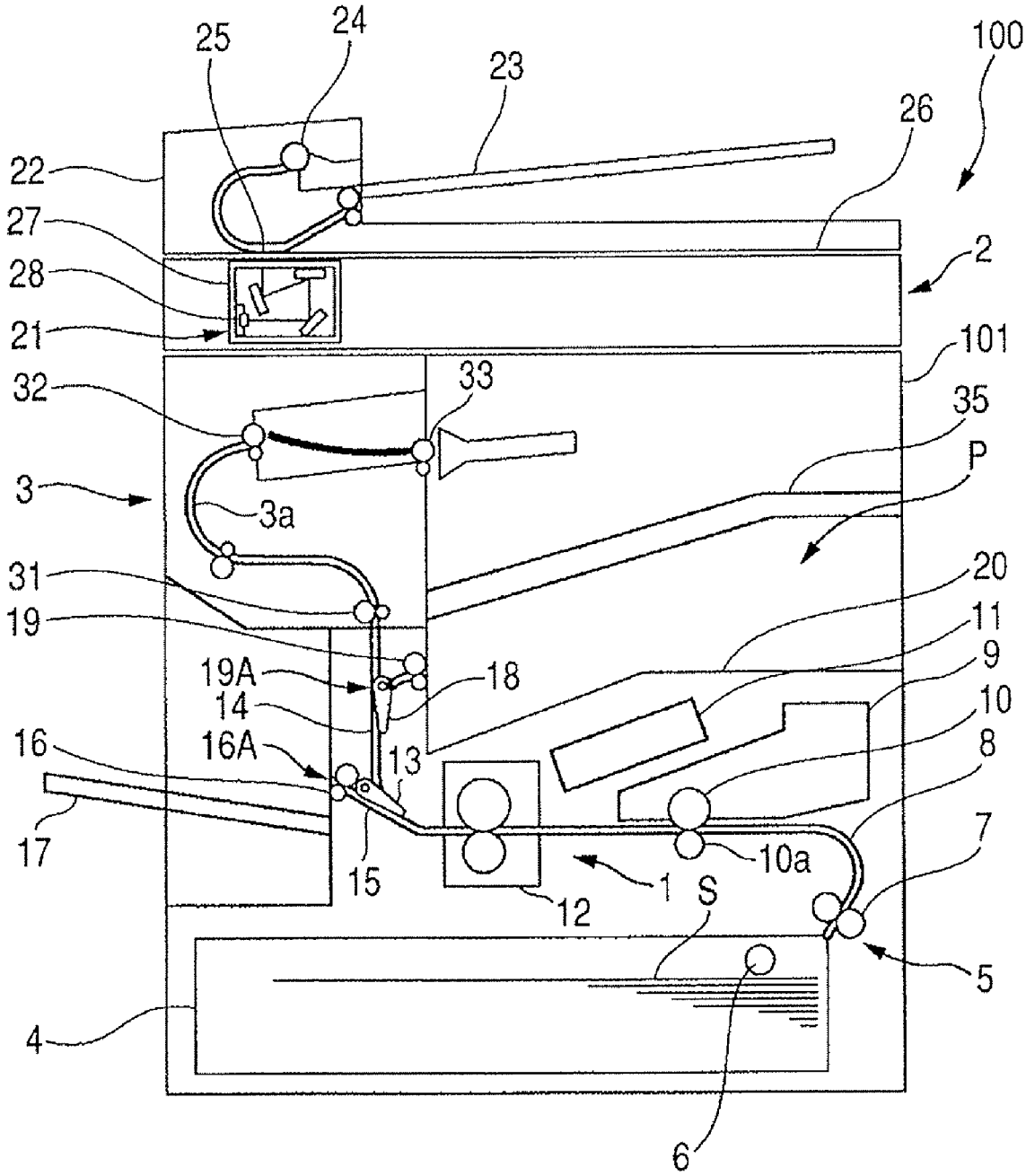
FIG. 1 is an illustration showing a schematic configuration of an image forming apparatus provided with the sheet processing apparatus of a first embodiment of the present invention.

FIG. 1 is an illustration showing the schematic configuration of an image forming apparatus provided with the sheet processing apparatus of a first embodiment of the present invention. In FIG. 1, an image forming apparatus 100 is set to an image forming apparatus body 101 provided with an image forming portion 1. A sheet processing apparatus 3 for applying stapling to a selectively-conveyed sheet after an image is formed by the image forming portion 1 is set to the top of the image forming apparatus body 101 and moreover, an image reader 2 is set above the sheet processing apparatus 3.

The image forming apparatus 100 is of an in-apparatus sheet discharge type in which a sheet discharge space P for discharging a sheet on which an image is formed by the image forming portion 1 is set between the image reader 2 and the sheet processing apparatus 3.

In this case, the image reader 2 for reading an original image has a scanner portion 21 serving as an image reading portion and an ADF (automatic original feeding portion) 22. The ADF 22 separates and conveys a plurality of originals stacked on an original stacking tray 23 one by one by a conveying roller 24 and not-illustrated separation pad to pass them through an original read position 25 when the scanner portion 21 optically reads information described in the original. Moreover, the ADF 22 can open and close backward about a not-illustrated hinge at the back of the apparatus so as to be opened or closed when setting an original onto original table glass 26.

The scanner portion 21 is provided with an optical carriage 27 for reading the image of an original set on the original table glass along a not-illustrated guide shaft while scanning the image in the lateral direction and photoelectrically converting the original information read by the optical carriage 27 by a CCD 28. When an original is read by the ADF 22, the optical carriage 27 stops at a predetermined position to read an original currently conveyed.

The image forming apparatus body 101 is provided with not only the image forming portion 1 for forming an image (toner image) according to the electrophotographic mode but also a sheet feeding portion 5 for feeding a sheet to the image forming portion 1, fixing portion 12, and first and second sheet discharging portions 16A and 19A.

In this case, the image forming portion 1 includes a process cartridge 9 provided with a photosensitive drum 10, not-illustrated electrification roller, development counter, and toner vessel and a laser scanner 11 for exposing the surface of the photosensitive drum 10 and forming an electrostatic latent image on the drum 10.

Moreover, the sheet feeding portion 5 has a sheet feeding cassette 4 in which a plurality of sheets S to be used for image formation are stacked and a pickup roller 6 for feeding the sheet S housed in the sheet feeding cassette 4.

The first sheet discharging portion 16A has a first flapper 13, first sheet discharging roller 16, and face-up conveying route 15 and the second sheet discharging portion 19A has a second flapper 18, second sheet discharging roller 19, and face-down conveying route 14.

The second flapper 18 can be switched to the position for making an image-formed sheet head for the sheet processing apparatus 3 shown in FIG. 1 and the sheet discharging position for discharging an image-formed sheet to a discharged-sheet stack portion 20 formed on a discharged-sheet space P. Moreover, the first flapper 13 can be switched to the position shown in FIG. 1 for discharging an image-formed sheet to a sheet discharging tray 17 in face-up and the sheet discharging position for making an image-formed sheet head for the face-down conveying route 14.

Figure 2:
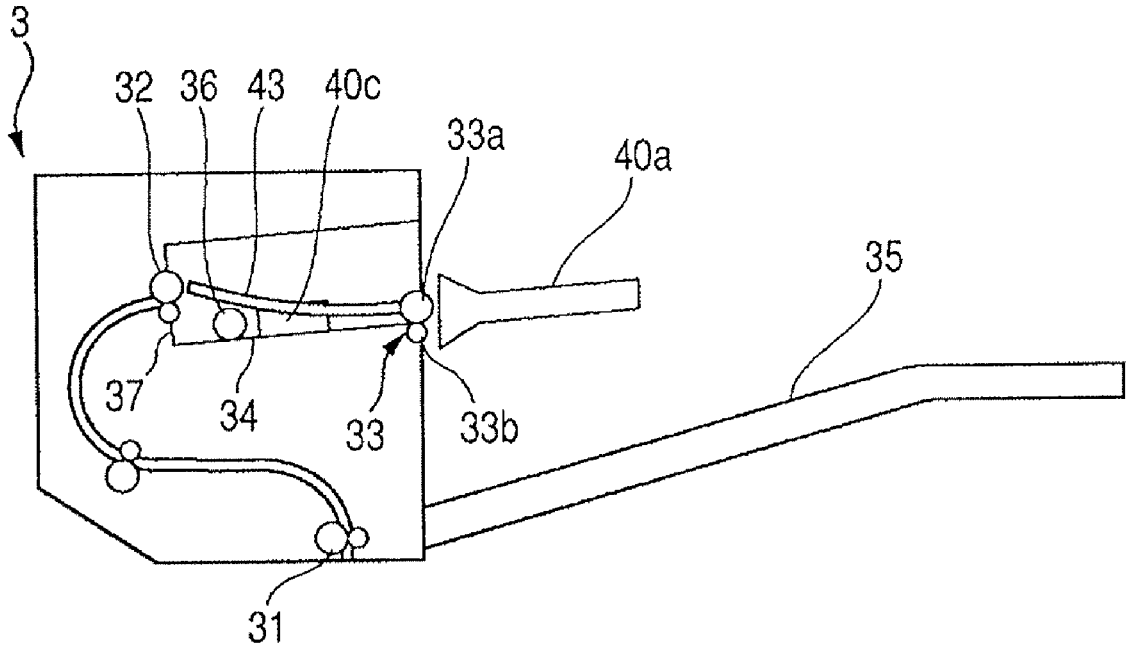
FIG. 2 is an illustration for describing the configuration of the above sheet processing apparatus.

Furthermore, the sheet processing apparatus 3 applies the processing such as stapling to a sheet selectively guided by switching a second flapper 18. Then, as shown in FIG. 2, the apparatus 3 is provided with an intermediate staking portion 34 for processing sheets, intermediate conveying roller 32 for conveying sheets to the intermediate sheet stack portion 34, and connectable discharged-sheet roller pair 33 for discharging sheets processed by the intermediate sheet stack portion 34.

Moreover, the sheet processing apparatus 3 is provided with a first alignment reference wall 37 for aligning the end of a sheet in a conveyance direction by contacting with the rear end of the sheet conveyed to the intermediate sheet stack portion 34. Furthermore, the apparatus 3 is provided with an aligning roller 36 for conveying a sheet conveyed to the intermediate sheet stack portion 34 to the first alignment reference wall 37 side and bringing the rear end of the sheet into contact with the first alignment reference wall 37. In this case, the first alignment reference wall 37 and aligning roller 36 constitute a first aligning portion.

An entrance roller 31 conveys a sheet conveyed to the sheet processing apparatus 3 to the intermediate conveying roller 32 by switching of the second flapper 18. A discharged-sheet tray 35 stacks the sheets discharged from the discharged-sheet roller pair 33 after processing such as stapling is applied and a conveying guide 43 is set above the intermediate sheet stack portion 34 to guide a sheet conveyed by the intermediate conveying roller 32 to the intermediate sheet stack portion 34.

Then, operations of the image forming apparatus 100 thus constituted when forming an image are described below.

When forming an image on a sheet, an original is set to the original stacking tray 23 of the ADF 22. Then, by pressing a copy button, an original is conveyed to the original read position 25 by the sheet-feeding roller 24 of the ADF 22. Then, after applying light to the original from a not-illustrated light source, reading the reflected light by the optical carriage 27, and photoelectrically converting a read image signal by a CCD 28, the image signal is transferred to the laser scanner 11 of the image forming portion 1.

Then, when the image signal is input, the laser scanner 11 applies a laser beam corresponding to the image signal onto the photosensitive drum 10 and thereby, an electrostatic latent image is formed on the photosensitive drum 10. Thereafter, the electrostatic latent image is developed by a not-illustrated development counter and visualized as a toner image. The toner image formed on the photosensitive drum 10 is conveyed to a transfer nip portion between the photosensitive drum 10 and the transfer roller 10*a* as the drum 10 rotates.

However, the sheets S to be used for image formation are separately fed from the sheet feeding cassette 4 by the pickup roller 6 and separating roller pair 7 one by one and then, supplied to the transfer nip portion along the conveying guide 8. Thereby, the toner image on the photosensitive drum 10 is transferred to the sheets S by the transfer roller 10*a*.

Then, the sheets S to which a toner image is transferred from the photosensitive drum 10 is conveyed to the fixing portion 12 and heated and pressurized on the fixing portion 12, and a toner image is fixed on the surface of the sheets S.

In this case, when processing of the sheets S is unnecessary and the sheets S are discharged in face-up, the first flapper 13 is set to the sheet discharging position shown in FIG. 1. Thereby, the toner-image-fixed sheet S is conveyed along the face-up conveying route 15 and discharged in the state of face-up for the sheet-discharging tray 17 by the first sheet-discharging roller 16, that is, the state in which the face on which a toner image is formed is turned upward.

However, when the processing of a sheet is unnecessary and the sheet is discharged in face-down, the first flapper 13 is set to the discharge position for making the sheet S head for the face-up conveying route 14. Moreover, the second flapper 18 is set to the sheet discharging position for discharging a sheet to the discharged-sheet stack portion 20 set to the sheet-discharging space P.

Thereby, the toner-image-fixed sheet S is conveyed along the face-down conveying route 14 and then, discharged in the face-down state for the discharged-sheet stack portion 210 by the second sheet-discharging roller 19, that is, the state of turning the face on which a toner image is formed downward.

Moreover, when an image-formed sheet is set so as to be subjected to a process such as stapling or to be otherwise discharged from the sheet processing apparatus 3, the second flapper 18 is previously switched to the position shown in FIG. 1.

Then, by switching the second flapper 18, the sheet S is conveyed up to the intermediate sheet stack portion 34 through the entrance roller 31 and intermediate conveying roller 32 constituting a sheet conveying portion. The sheet-discharging roller 33 shown in FIG. 2 is supported so that the upper roller 33*a* can be separated from the lower roller 33*b*. Moreover, when the sheet S is conveyed up to the intermediate sheet stack portion 34, because the discharging roller pair 33 is separated, the sheet S is not discharged by the discharging roller pair 33.

The sheets conveyed up to the intermediate sheet stack portion 34 are aligned one by one in the conveyance direction and width direction and an aligned sheet bundle is stapled as described later. Then, after completing stapling, the discharging roller pair 33 which has been separated contacts and discharges the sheet bundle to the discharged-sheet tray 35.

However, when stapling is not performed though sheets are discharged from the sheet processing apparatus 3, the sheet S conveyed by the intermediate conveying roller 32 is discharged to the discharged-sheet tray 35 by the discharging roller pair 33 without temporarily being collected in the intermediate sheet stack portion 34.

Figure 3:
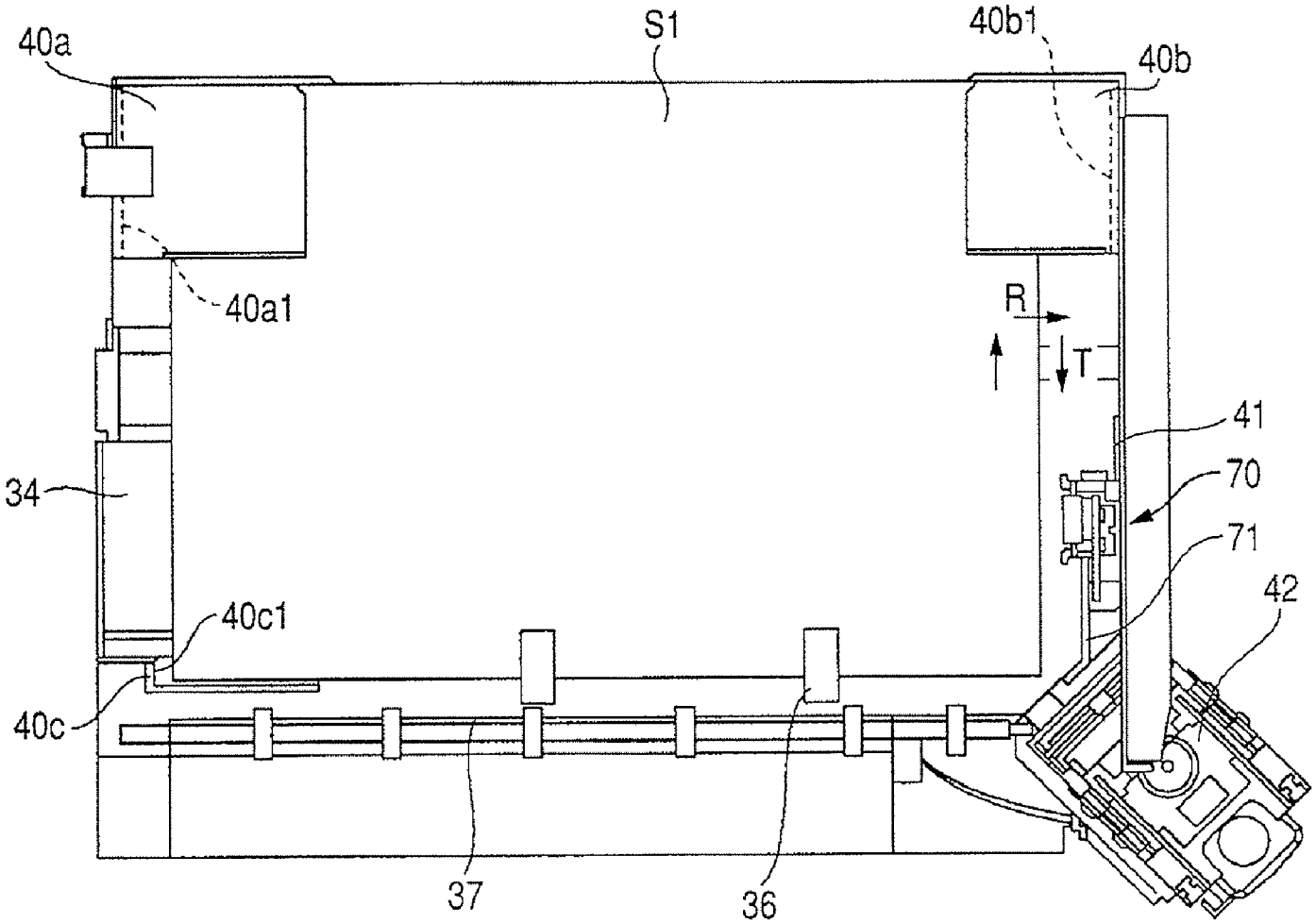
FIG. 3 is a top view of the above sheet processing apparatus.
Figure 4:
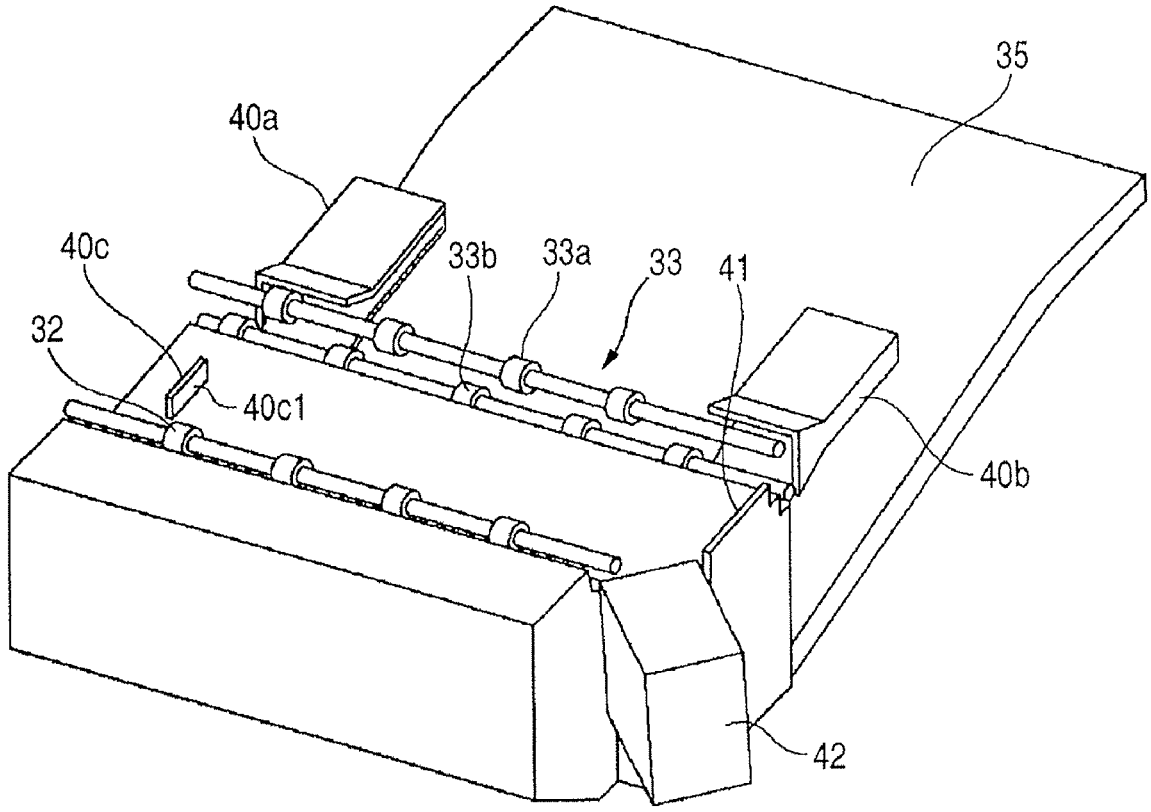
FIG. 4 is a perspective view of the above sheet processing apparatus.

A second alignment reference wall 41 for aligning the sheet-width-directional position is set to the intermediate sheet stack portion 34 serving as a sheet stack portion for stacking sheets to be processed as shown in FIGS. 3 and 4. Moreover, first to third joggers 40*a*, 40*b*, and 40*c* for moving sheets in the direction orthogonal to the conveyance direction (hereafter referred to as width direction) to bring it into contact with the second alignment reference wall 41 are included. Furthermore, a stapler 42 for stapling aligned sheet bundles is included. In this case, the second alignment reference wall 41 and first to third joggers 40*a*, 40*b*, and 40*c* constitute a second aligning portion.

The first to third joggers 40*a*, 40*b*, and 40*c* include sheet aligning faces 40*a*1, 40*b*1, and 40*c*1 contacting with the side end of sheet S1. Moreover, in the case of this embodiment, the first and second joggers 40*a* and 40*b* are U-shaped so as to be able to support a sheet from the underside. Furthermore, the first and second joggers 40*a* and 40*b* can be retracted so that the underside supporting a sheet from lower portion moves to a position outside of the width of a sheet, in order to discharge the stapled sheets onto the stacking tray 35.

Furthermore, the third jogger 40*c* at the upstream side of the sheet discharging pair 33 moves in the width direction in association with first jogger 40*a* by a not-illustrated interlocking mechanism. Thereby, the first and third joggers 40*a* and 40*c* can align a sheet by interlocking each other. Moreover, the second jogger 40*b* set to the second alignment reference wall 41 side is fixed to a position in which the sheet aligning face becomes the same face as the second alignment reference wall 41.

The aligning roller 36 can vertically move from the intermediate sheet stack portion 34. When the roller 36 lowers, it contacts with the surface of a sheet on the intermediate sheet stack portion 34 so as to make the sheet S1 head for the first alignment reference wall 37 for aligning a rear end position of a sheet in a conveyance direction. Moreover, when the roller 36 rises, it refracts up to a position to which a sheet is smoothly brought in.

In the case of this embodiment, an aligning portion dedicated to each direction is prepared for alignments of two directions orthogonal as an aligning portion. However, it is also allowed to perform alignments of two directions by one aligning portion provided with a transfer member for diagonally transferring the sheet S1 toward the binding position of a stapler serving as a binding unit.

Figure 5:
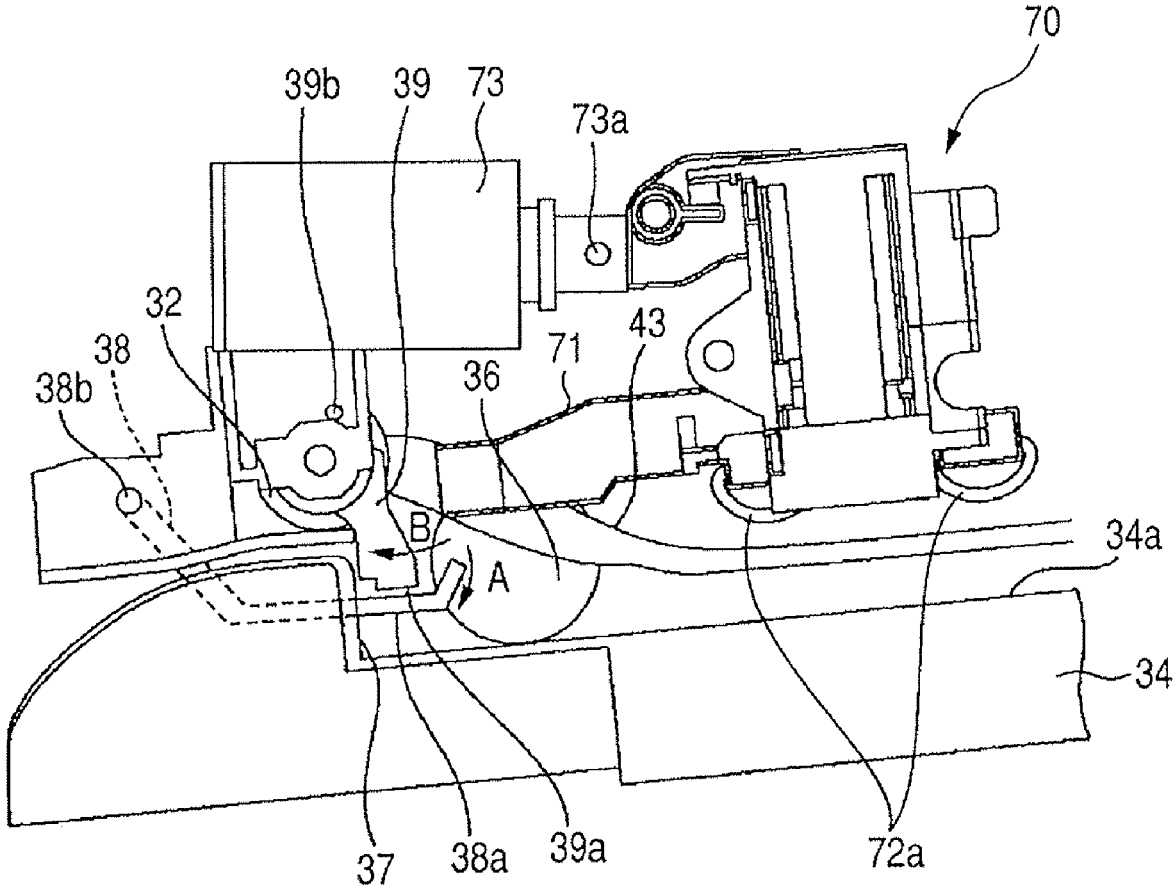
FIG. 5 is an illustration for describing the configuration of an intermediate sheet stack portion set to the above sheet processing apparatus.

Moreover, as shown in FIG. 5, the intermediate sheet stack portion 34 is provided with a first pressing member 38 and second pressing member 39. In this case, the first pressing member 38 is rotatably held by a fulcrum 38*b* set to the upstream side of the nip position of the intermediate conveying roller 32 and energized in the direction of the arrow A by a not-illustrated energizing member such as a spring.

The first pressing member 38 rotates upward by being pressed by a sheet to be conveyed when the sheet is conveyed to the intermediate stacking portion 34 and refracts up to a position which does not interrupt conveyance of a sheet. Moreover, when a sheet is not conveyed, the sheet is present at an upper position by a predetermined distance from the stacking face 34*a* of the intermediate sheet stack portion 34 and the underside 38*a* contacting with a sheet is protruded from the first alignment reference wall 37.

The second pressing member 39 is rotatably held by the fulcrum 39*b* at a position in which the member 39 contacts with the front end of a sheet at the downstream side of the nip position of the intermediate conveying roller 32 and energized in the direction of the arrow B by a not-illustrated energizing member such as a spring.

The second pressing member 39 also rotates upward by being pressed by a conveyed sheet when the sheet is conveyed to the intermediate sheet stack portion 34 and refracts up to a position which does not interrupt conveyance of a sheet. When a sheet is not conveyed, the underside 38*a* of the first pressing member 38 is located below the underside 39*a* of the second pressing member.

Then, by arranging the first and second pressing members 38 and 39 like this, even when the sheet conveyed by the intermediate stacking portion 34 lifts the first pressing member 38, the second pressing member 39 is able to prevent the lift of a precedent sheet stacked on the intermediate sheet stack portion 34. That is, it is possible to prevent interference or collision between the front end of a subsequent sheet to be conveyed to the intermediate sheet stack portion 34 and the rear end of a precedent sheet stacked on the intermediate sheet stack portion 34.

Figure 6:
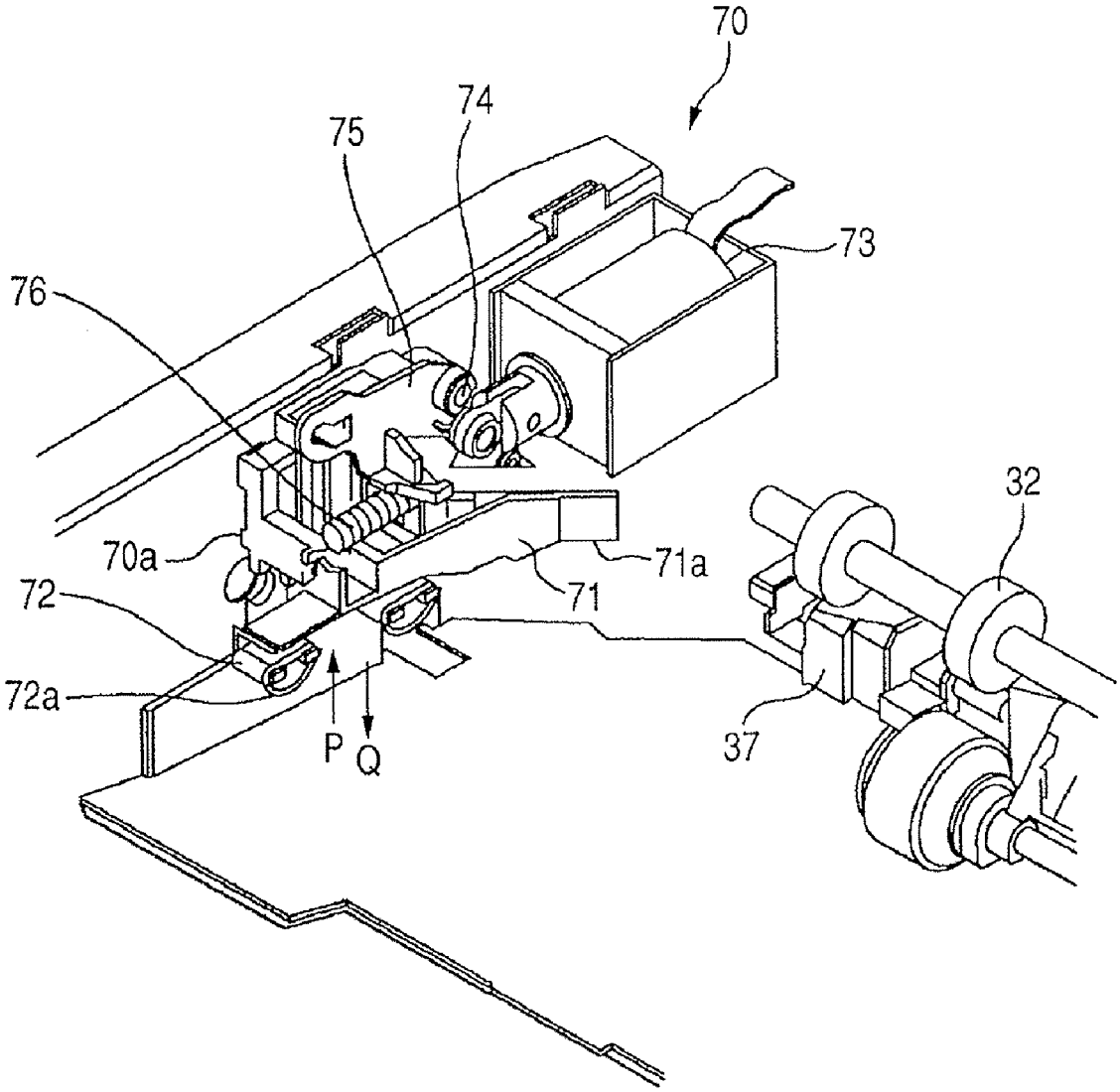
FIG. 6 is a perspective view for describing the configuration of a pressing unit set to the above intermediate sheet stack portion.

Moreover, in FIG. 5, the pressing unit 70 is set to the downstream of the intermediate conveying roller 32 and prevents extrusion of a precedent sheet by a subsequent sheet by pressing the top of a sheet whose side end is aligned as described later. As shown in FIG. 6, the pressing unit 70 includes the regulation member 71 set to the unit body 70*a*, pressing member 72 integrally set to the unit body side of the regulation member 71, solenoid 73, axis 74, link 75, and spring 76.

The regulation member 71 and pressing member 72 are set to positions acting only on sheets aligned outside the conveying region of a sheet to be conveyed to the intermediate sheet stack portion 34 by the intermediate conveying roller 32.

The regulation member 71 is energized in the direction of the arrow P due to rotation of the link 75 about the axis 74 by the energizing force of a normal spring 76. When the solenoid 73 serving as a driving unit operates, the regulation member 71 moves in the direction of arrow Q in accordance with the rotation of the link 75 about the axis 74.

Figure 7:
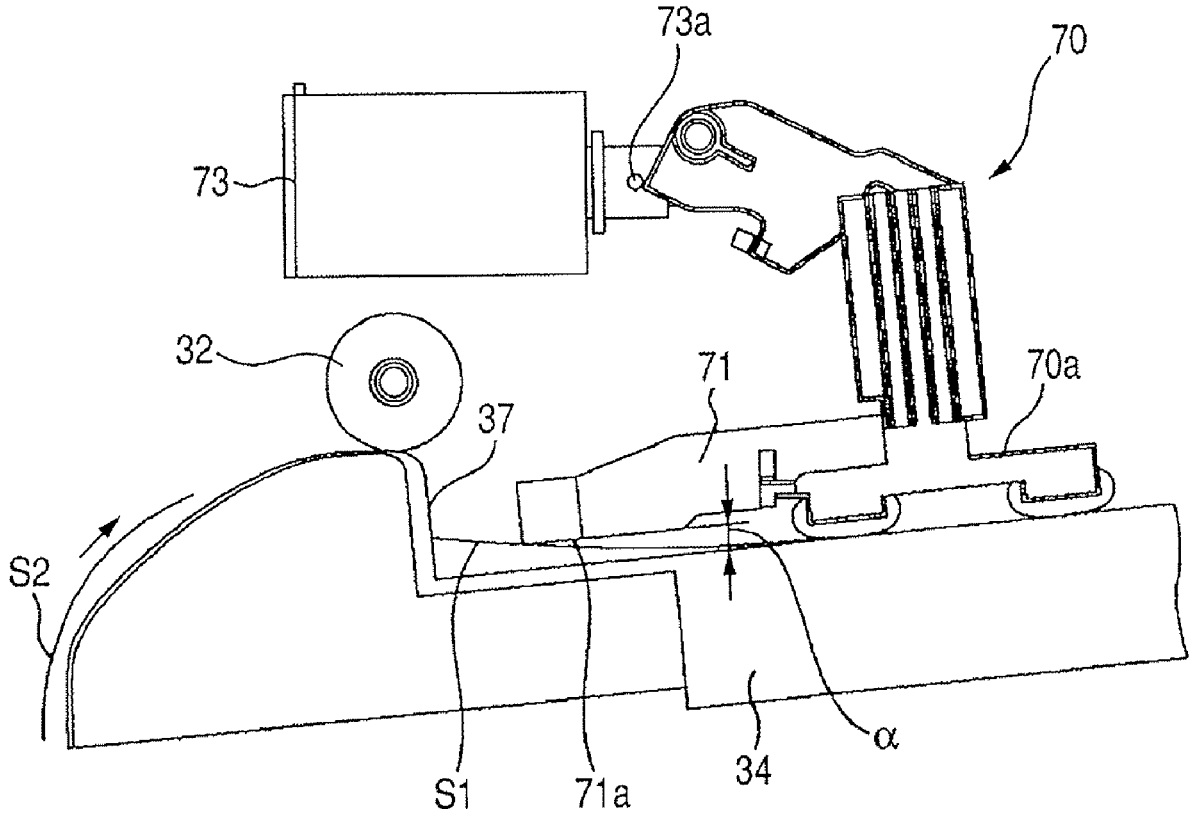
FIG. 7 is a side view for describing the configuration of the above pressing unit.
Figure 8:
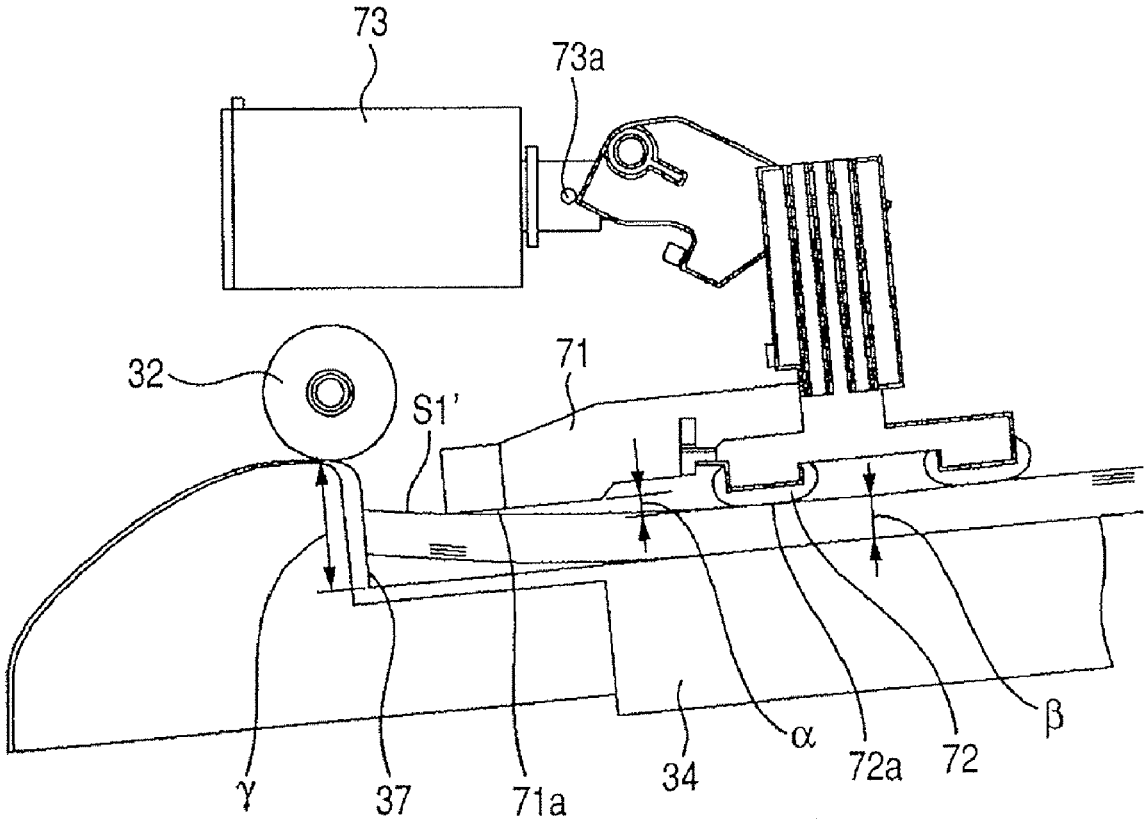
FIG. 8 is an illustration for describing operations of the above pressing unit.

In this case, the underside 71*a* of the regulation member 71 is constituted so as to be located at a position upper than the underside 72*a* of the pressing member 72 elastically deformed by pressing the sheet S1 as shown in FIG. 7 by the gap $\alpha$. Moreover, the underside 71*a* is constituted so as to be located upstream of the underside 72*a* of the pressing member 72 in a conveyance direction, that is, at the first alignment reference wall side.

Moreover, by using the above configuration, it is possible to regulate upward movement of sheet rear end as a control face though the underside 71*a* of the pressing member 71 cannot completely press the lift of the sheet S1 even when the rear end of the sheet S1 is curled upward.

That is, in the case of this embodiment, when the sheet S1 is pressed by the pressing unit 70, the sheet S1 is fixed by pressure-contacting the underside 72*a* constituting the pressure-contact face of the pressing member 72 serving as a pressing member against the top of the sheet S1. Moreover, movement (lift) of the rear end of the sheet S1 pressed against by the pressing member 72 is regulated by the underside 71*a* constituting the regulation surface of the regulation member 71 serving as a regulation member. The underside 72*a* of the pressing member 72 is formed of an elastic body to fix the sheet S1 in an elastically-deformed state.

Then, the sheet processing operation of the thus-constituted sheet processing apparatus 3 provided with the pressing unit 70 is described below.

When a sheet is conveyed to the sheet processing apparatus 3, a sheet conveyed by the entrance roller 31 is discharged to the intermediate sheet stack portion 34 by the intermediate conveying roller 32. Before the sheet is conveyed to the intermediate sheet stack portion 34, the first to third joggers 40*a* to 40*c* are moved to positions in which a sheet aligning face is wider by a predetermined amount than the conveying region of sheets. Thereby, sheets are conveyed to the intermediate stacking potion 34 without colliding with the first to third joggers 40*a* to 40*c* and undersides of the sheets are supported by the first to third joggers 40*a* to 40*c*.

Moreover, the sheet discharging pair 33 separates before the rear end of a sheet is removed from the intermediate conveying roller 32 at latest and stops rotation. Thereby, the sheet removed from the intermediate conveying roller 32 is stacked on the intermediate sheet stack portion 34.

When stacking a sheet on the intermediate sheet stack portion 34, since the regulation member 71 is located at the outside of the width of the sheet S1, that is, at a position outside of the sheet conveying region, the sheet S1 does not collide with the regulation member 71.

Then, after stacking the sheet S1 on the intermediate sheet stack portion 34, the first jogger 40*a* and third jogger 40*c* interlocking with the first jogger 40*a* are moved in the direction of arrow R shown in FIG. 3 to move the sheet S1 in the width direction.

In this case, as described above, the second jogger 40*b* is fixed to the position where the sheet aligning face becomes the same face as the second alignment reference wall 41. Moreover, when the sheet S1 is moved by the first and third joggers 40*a* and 40*c*, the side end of the sheet S1 is brought into contact with the sheet aligning face of the second jogger 40*b* and second alignment reference wall 41 and thereby, the width-directional position of the sheet S1 is aligned. In this case, the regulation member 71 is moved to an upper position which is a refracting portion not interrupting alignment of sheets by the first and third joggers 40*a* and 40*c*.

Then, when alignment of the side end position of the sheet S1 is completed, the aligning roller 36 lowers and contacts with the surface of the sheet S1. Thereafter, the sheet S1 is moved in the direction shown by the arrow T to bring the rear end of the sheet S1 in contact with the first alignment reference wall 37. Thereby, the rear end position of the sheet S1 is regulated and the conveyance direction of the sheet S1 is aligned. When alignments of the width direction and conveyance direction of the sheet S1 are completed, the rear-end corner portion of the sheet S1 enters the frontage of the stapler 42. In this case, the position of the sheet S1 is a sheet binding position and stapling is performed after alignment of the final sheet of sheets to be stapled is completed.

Then, after alignments of the width direction and conveyance direction of the sheet S1 like this is completed, the solenoid 73 operates. Thereby, the regulation member 71 and pressing member 72 move to the direction of the arrow Q shown in FIG. 6 integrally with the unit body 70*a* and regulates and presses the top of the aligned sheet S1 as shown in FIG. 7.

In this case, by regulating the top of the precedent sheet S1 by the regulation member 71, it is possible to securely convey and stack the subsequent sheet S2 on the intermediate sheet stack portion 34 without being interrupted by lift of the rear end of the precedent sheet S1.

Moreover, because the regulation member 71 is set to the outside of the conveying region of the subsequent sheet S2 to be conveyed to the intermediate sheet stack portion 34, the subsequent sheet S2 does not collide with the regulation member 71. Furthermore, because the precedent sheet S1 is energized by the pressing portion 72 set to the unit body 70*a* integrally with the regulation member 71, shift does not occur by friction with the subsequent sheet S2.

However, the subsequent sheet S2 conveyed to the intermediate sheet stack portion 34 is aligned by the first to third joggers 40*a* to 40*c*. In this case, however, the regulation member 71 and pressing member 72 refract in the direction of the arrow P in FIG. 6 in order to accept sheets. To reduce the aligning time, the first to third joggers 40*a* to 40*c* move the subsequent sheet S2 at a high operation speed. However, because the regulation member 71 operates in association with movement of the pressing member 72, the member 71 does not interfere with the subsequent sheet S2 due to delay of retraction of either of the members.

As a result, the regulation member 71 moves to the upper position of the stacking face 34*a* of the intermediate sheet stack portion 34 and the subsequent sheet S2 does not collide with the regulation member 71. Moreover, this operation is repeated until reaching a predetermined number of sheets.

For this embodiment, the constitution in which the regulation member 71 is integrally formed with the pressing member 72 is described. However, it is enough that the members 71 and 72 can integrally move at each refracting portion at the time of sheet alignment and the members 71 and 72 are not restricted to this configuration. Namely, it is enough that the regulation member 71 and the pressing member 72 can move in association with each other. However, by integrally constituting the members 71 and 72, they can move by one driving unit. Therefore, it is possible to simplify a structure and realize downsizing and cost reduce.

Hereafter, when alignment of the final sheet is completed, the first and third joggers 40*a* and 40*c* are moved up to a position where the first and third joggers 40*a* and 40*c* contact with the end surface of the sheet and completely aligned and the stapler 42 serving as a binding unit is driven to staple sheets. Thereafter, the first and second joggers 40*a* and 40*b* shown in FIG. 4 are completely refracted up to a position at which the underside is wider than the width of a sheet and a sheet bundle is discharged to the stacking tray 35 and stacked by contacting the discharging roller pair 33 and conveying the sheet bundle.

When the top of the sheet S1 is regulated by the regulation member 71, the underside 71*a* of the regulation member 71 is present upward from the underside 72*a* of the pressing member 72 deformed by pressing the sheet S1 by a predetermined gap $\alpha$ as shown in FIG. 7. Therefore, lift of a sheet rear end is not completely pressed.

Figure 18:
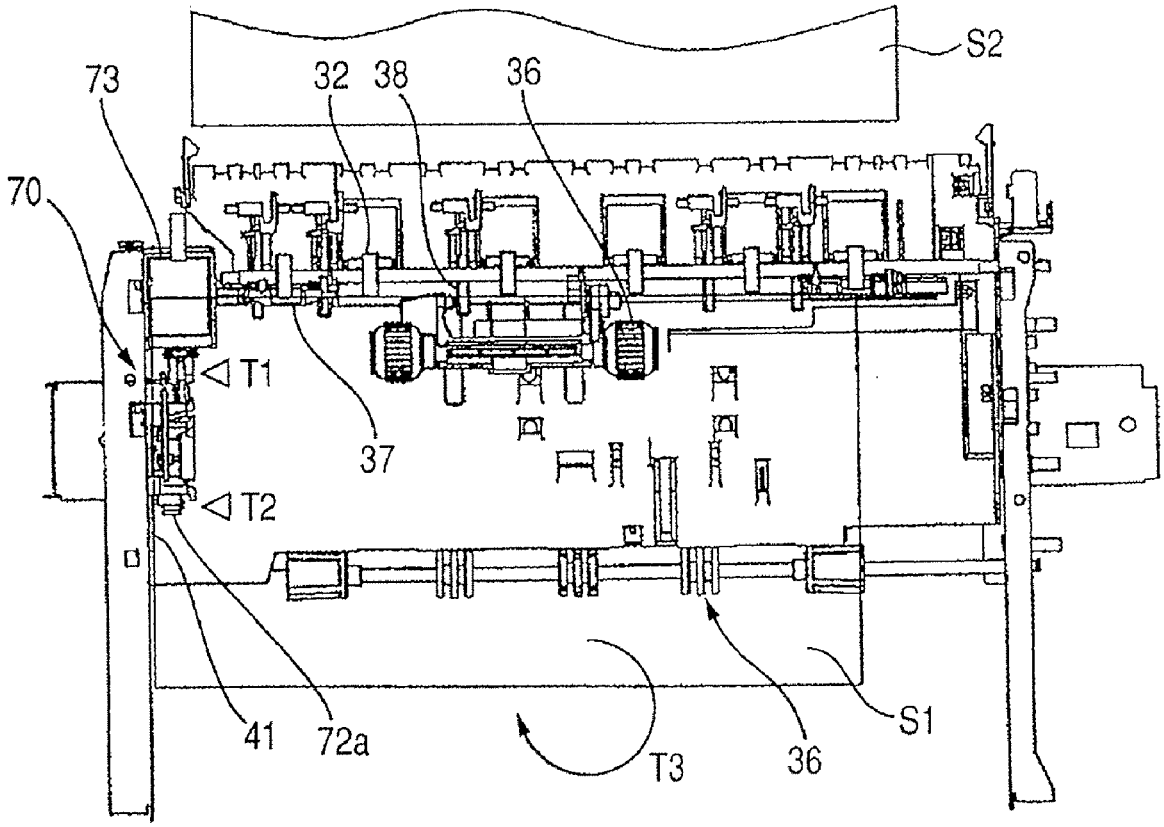
FIG. 18 is a top view for describing the sheet pressing operation of the pressing unit.

In this case, when completely pressing the lift of the rear end of the sheet S1, the rear end of the sheet leans to the first alignment reference wall 37 as shown in FIG. 18 already described and consistency of the rear end of a stapled sheet is degraded. Moreover, to completely press the lift of the rear end of the sheet S1 due to fixing-heat curl, large force is necessary and size up and cost up of an actuator are necessary.

However, in the case of this embodiment, when the regulation member 71 lowers, a gap (step) is formed between the underside 71*a* of the regulation member 71 and the underside 72*a* of the pressing member 72. Therefore, lift of the rear end of the sheet S1 is not completely pressed. That is, upward movement of the rear end of the aligned sheet is regulated instead of completely pressing the lift of the rear end by the underside 71*a* of the regulation member 71.

Then, by using the above configuration, it is possible to reduce the quantity for pressing the rear end of the sheet S1 by a predetermined gap $\alpha$, greatly reduce the load of an actuator, and select a low-cost space-saving actuator. Moreover, the curvature of the rear end of a sheet is moderated and when regulating the sheet S1, the rear end of the sheet S1 does not bent and lean to the first alignment reference wall 37.

When the gap $\alpha$ is large, it exceeds the nip line of the intermediate conveying roller 32. Therefore, it is necessary to set the gap $\alpha$ to a value at which the height obtained by adding the bundle thickness $\beta$ of the necessary number of stapled sheets and the gap $\alpha$ becomes smaller than the height y of the nip line of he intermediate conveying roller 32 from the intermediate stacking face 34. Therefore, in the case of this embodiment, the gap $\alpha$ is set to 2 mm through experiments.

Moreover, because a sheet is conveyed onto the intermediate sheet stack portion 34 through the opening of the staple 42, the front end of the subsequent sheet S2 and the rear end of the precedent sheet S1 cross in the opening of the stapler 42. Therefore, the front end of the subsequent sheet S2 is interrupted by the lift of the rear end of the precedent sheet S1 at a low portion close to the frontage of the stapler 42 of the alignment reference wall as shown in already-described FIG. 17. Therefore, in the case of this embodiment, the underside 71*a* of the regulation member 71 is set to a position close to the stapler frontage close to the binding position of the stapler 42.

Thus, when the regulation member 71 moves to the regulating position, it is possible to align the rear end of the precedent sheet S1 without being buckled by regulating upward movement (lift) of the rear end of the precedent sheet S1 by the underside 71*a* of the regulation member 71. Thereby, it is possible to staple (bind) a sheet bundle without misalignment of the rear end of a sheet.

Moreover, by using the above configuration, the sheet processing apparatus 3 can have a curl pressing function and precedent-sheet pressing function without newly using a curl pressing member without size up or cost up of a regulation member.

Then, second embodiment of the present invention is described below.

Figure 9:
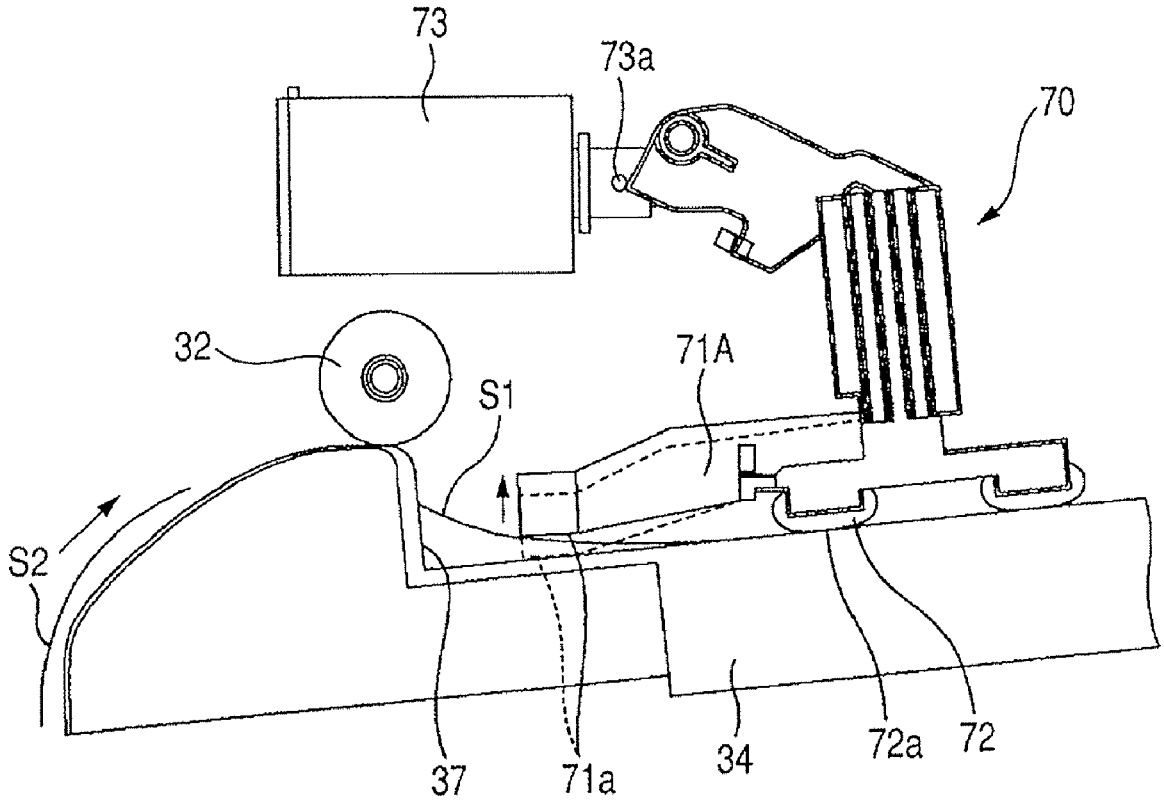
FIG. 9 is an illustration showing the schematic configuration of an intermediate sheet stack portion set to the sheet processing apparatus of a second embodiment of the present invention.

FIG. 9 is an illustration showing a schematic configuration of an intermediate sheet stack portion set to the sheet processing apparatus of this embodiment. In FIG. 9, a symbol same as that in FIG. 7 shows the same or corresponding portion.

In the case of this embodiment, the pressing member 71A shown in FIG. 9 is formed of an elastic body. Thereby, when the pressing member 71A lowers, the underside 71*a* of the pressing member 71A is pressed by a force equal to or more than predetermined force by the lift force of the sheet S1 and thereby, the pressing member 71A is elastically rotated upward.

Then, by using the above configuration, it is possible to regulate the upward movement of the rear end of the precedent sheet S1 without buckling the rear end of the precedent sheet S1. Thereby, it is possible to staple a sheet bundle without causing the misalignment of the rear end of a sheet.

Moreover, by using the above configuration, the pressing member 71A absorbs the force equal to or larger than predetermined force. Therefore, it is possible to provide a curl pressing function for the pressing member 71A without size up or cost up of an actuator.

Figure 10:
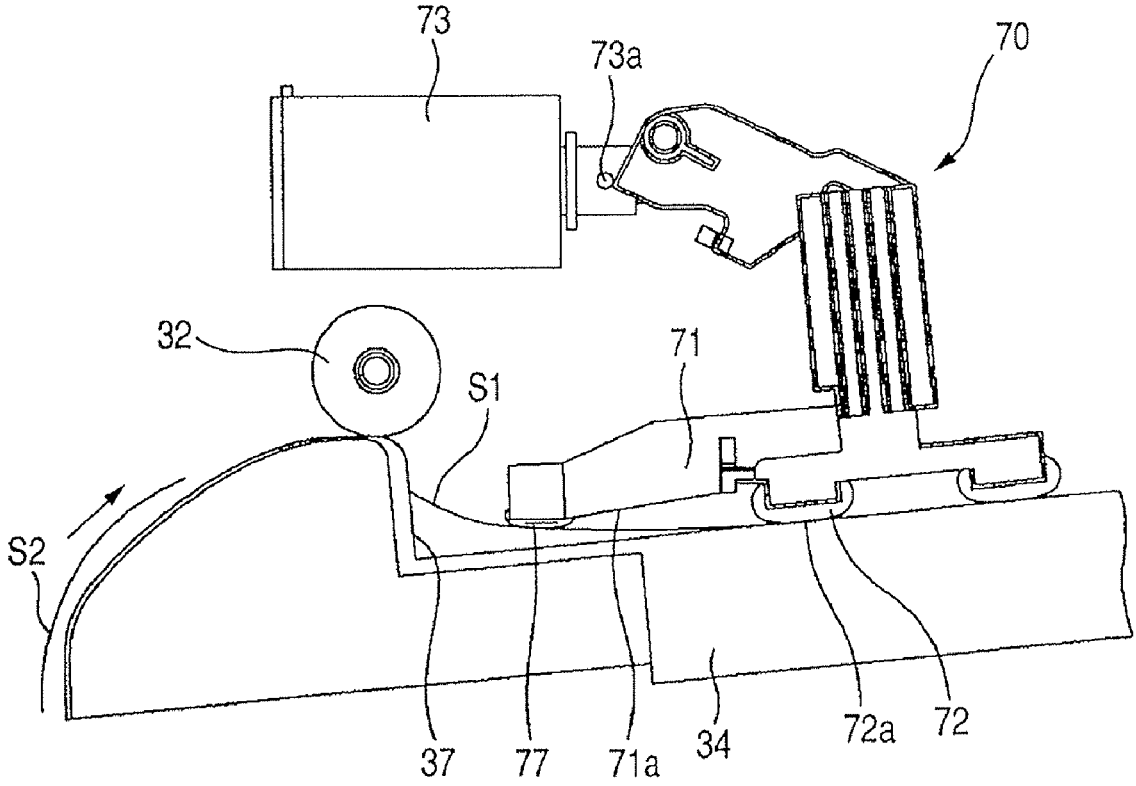
FIG. 10 is a perspective view for describing another configuration of the above intermediate sheet stack portion.
Figure 11:
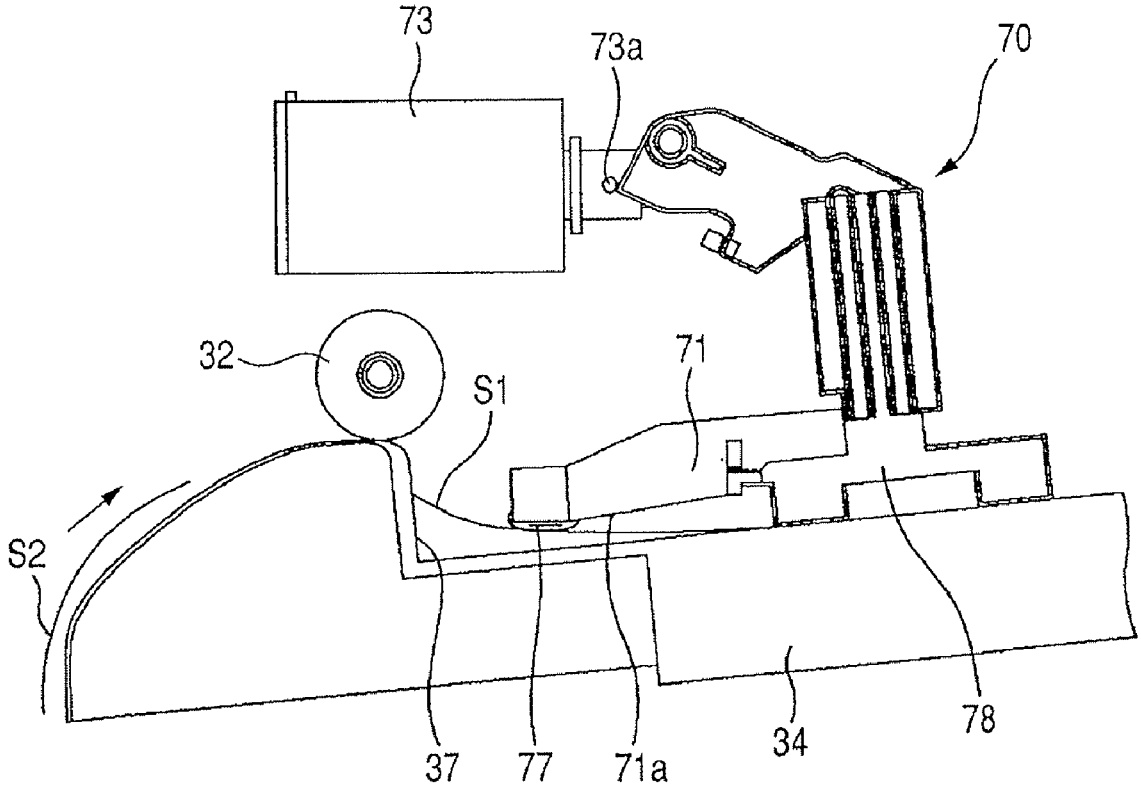
FIG. 11 is a perspective view for describing still another configuration of the above intermediate sheet stack portion.

This embodiment is not restricted to the configuration as shown in FIG. 9 when the underside 71*a* of the pressing member 71A can absorb the lift force of a sheet. For example, when the underside 71*a* of the pressing member 71A can absorb the lift force of a sheet, it is allowed to set an elastic body 77 to the underside 71*a* of the pressing member 71 as shown in FIG. 10. Moreover, as shown in FIG. 11, the same advantage is obtained by setting the elastic body 77 to the underside 71 of the pressing member 71 as shown in FIG. 11 and using the pressing member 72 as a rigid body 78.

As shown in FIG. 3 described for the first embodiment, the underside 72*a* of the pressing member 71 is set to the second alignment reference wall 41 side of the underside 71*a* of the regulation member 71 so as to bring the underside 71*a* of the regulation member 71 to a position close to the binding position of the stapler 42. However, the position of the underside 72*a* of the pressing member 72 is not restricted to the above position.

Figure 12:
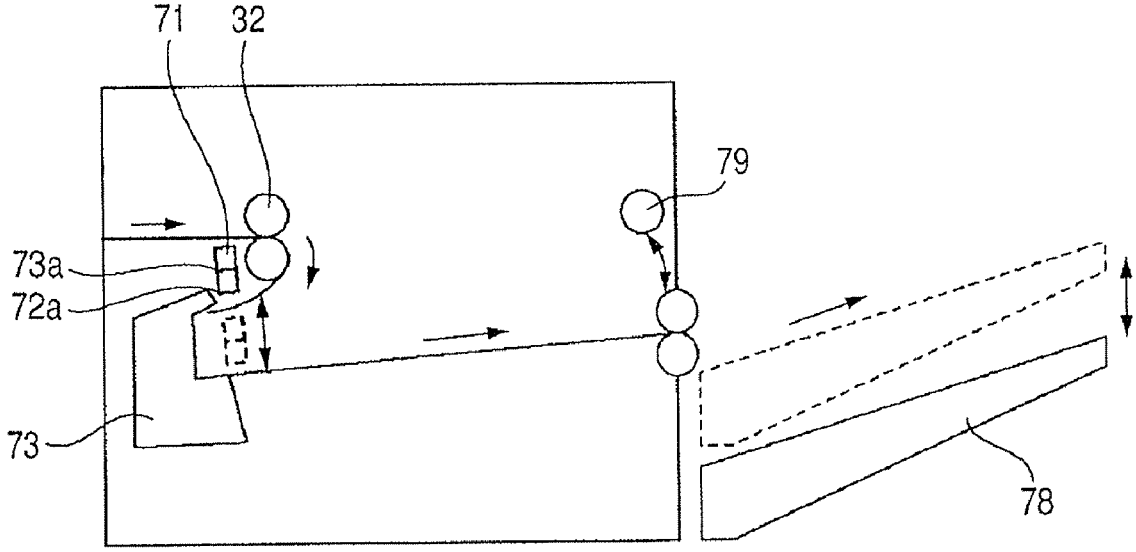
FIG. 12 is an illustration showing a schematic configuration of the sheet processing apparatus of the second embodiment of the present invention.
Figure 13:
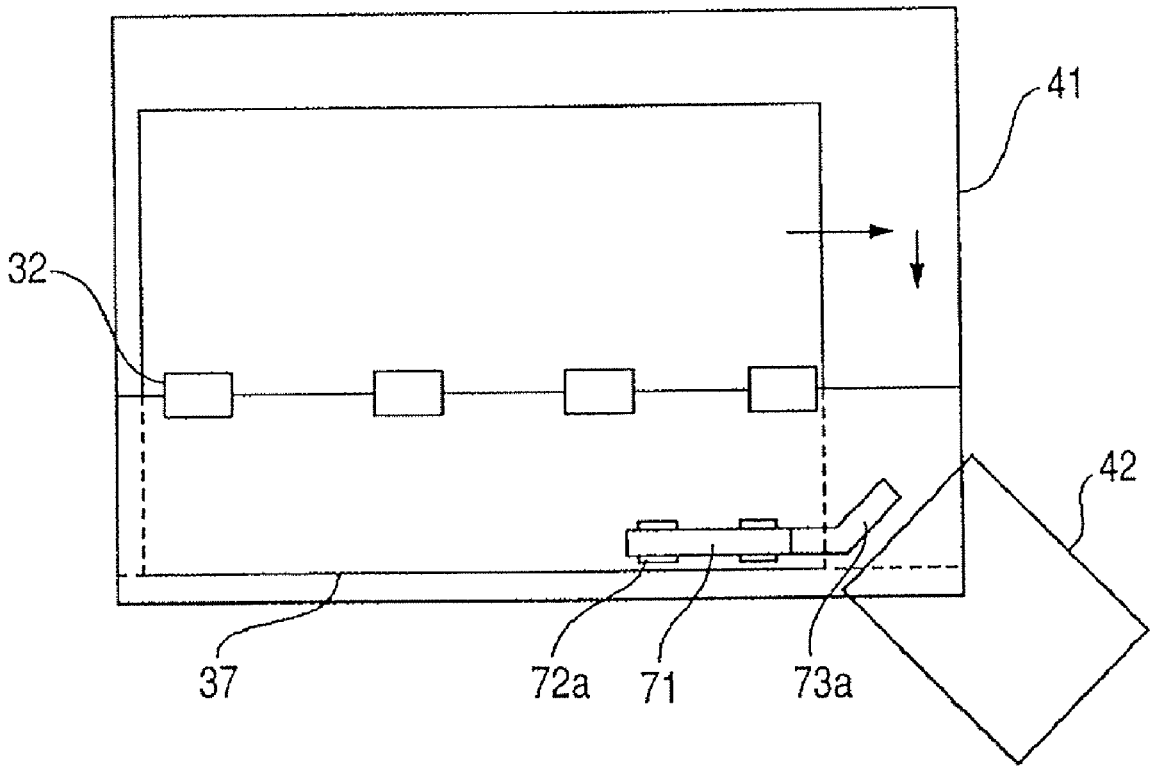
FIG. 13 is an illustration showing the schematic configuration of an intermediate sheet stack portion set to the above sheet processing apparatus.

For example, when it is possible to locate the underside 71*a* of the regulation member 71 to a position close to the binding position of the stapler 42, it is allowed to set the regulation member 71 along the first alignment reference wall 37 as shown in FIGS. 12 and 13. Moreover, in this case, it is allowed to set the underside 72*a* of the pressing member 72 in the sheet conveying region and the underside 71*a* of the regulation member 71 outside the sheet conveying region.

Then, third embodiment of the present invention is described below.

As described for the first embodiment, a pressing unit 70 in FIG. 5 is set to the downstream of the intermediate conveying roller 32 for the side end to press the top of a side-end aligned sheet close to its side end and prevent extrusion of a precedent sheet by a subsequent sheet.

As shown in FIGS. 5 and 6, the pressing unit 70 is provided with a regulation member 71 for regulating upward movement of the rear end of a sheet, pressing member 72 integrally set to the regulation member 71 to press a sheet against the stacking face 34*a* of the intermediate sheet stack portion 34, and link member 75.

In this case, vertical movement of the regulation member 71 is guided by a vertically-extended rail 90. Moreover, the pressing member 72 is formed of an almost-elliptic elastic body having a hollow portion and a plurality of pressing members 72 or two pressing members 72 for this embodiment are set at the lower end of the regulation member 71. The underside 72*a* of the pressing member 72 constitutes a pressing face for pressing a sheet. By setting a plurality of the pressing members 72 in the conveyance direction at predetermined intervals, the pressing state of a precedent sheet is not disarranged even if moment is generated due to sliding when conveying a subsequent sheet. In the case of this embodiment, though a plurality of pressing members are set at predetermined intervals so as to oppose the moment due to sliding, it is also allowed to use a pressing member obtained by continuously constituting a pressing face having a predetermined length.

A link member 75 is rotatably supported by a not-illustrated frame of the sheet processing apparatus 3 about a rotating shaft 75*a*, which stops while being energized in the direction of the arrow C in FIG. 6 by the spring 76 shown in FIG. 6 at the state shown in FIG. 5.

Moreover, the link member 75 is connected with (pin 73*a*) of the solenoid 73 through a joint 74. When the joint 74 is pulled when the solenoid 73 is turned on, the link member 75 rotates counterclockwise about the rotating shaft 75*a*. FIG. 5 shows a state when the solenoid 73 is turned off.

Moreover, the link member 75 has a cam hole 75*b* and the boss 71*b* of the regulation member 71 is fitted into the cam hole 75*b*. Furthermore, when the link member 75 is present at the position shown in FIG. 5, the regulation member 71 is energized upward by fitting with the link member 75 and stops at the position in FIG. 5.

Then, the sheet processing operation by the sheet processing apparatus 3 provided with the pressing unit 70 thus constituted is described.

When a sheet is conveyed to the sheet processing apparatus 3, the sheet conveyed by the entrance roller 31 is discharged to the intermediate sheet stack portion 34 by the intermediate conveying roller 32. Before the sheet is conveyed to the intermediate sheet stack portion 34, the first to third joggers 40*a* to 40*c* are moved to positions in which a sheet aligning face is wider than the conveying region by a predetermined value. Thereby, the sheet is conveyed to the intermediate sheet stack portion 343 without colliding with the first to third joggers 40*a* to 40*c* and the underside of the sheet is supported by the first to third joggers 40*a* to 40*c*.

Moreover, the sheet discharging roller pair 33 is separated before the rear end of the sheet is removed from the intermediate conveying roller 32 at latest and stops rotation. Thereby, the sheet moved from the intermediate conveying roller 32 is stacked on the intermediate sheet stack portion 34.

When stacking the sheet on the intermediate staking portion 34, the sheet S1 does not collide with the regulation member 71 because the regulation member 71 is located at a position outside of the width of the sheet S1, that is, outside of the sheet conveying range.

Moreover, after stacking the sheet S1 on the intermediate sheet stack portion 34, the first jogger 40*a* and the third jogger 40*c* interlocking with the first jogger 40*a* are moved in the direction of arrow R shown in FIG. 3 to move the sheet S1 in the width direction.

In this case, as already described, the second jogger 40*b* is fixed to a position at which the sheet aligning face becomes the same face as the second alignment reference wall 41. Moreover, when the sheet S1 is moved by the first and third joggers 40*a* and 40*c*, the side end of the sheet S1 contacts with the sheet aligning face of the second jogger 40*b* and second alignment reference wall 41. Thereby, the position in the width direction of the sheet S1 is aligned. In this case, the regulation member 71 is moved to an upper position which is a refracting portion which does not interrupt alignment of a sheet by the first and third joggers 40*a* and 40*c*.

Then, when alignment of the side end position of the sheet S1 is completed, the aligning roller 36 lowers and contacts with the surface of the sheet S1. Thereafter, the sheet S1 is moved in the direction shown by the arrow T to bring the rear end of the sheet S1 into contact with the first alignment reference wall 37. Thereby, the rear end position of the sheet S1 is regulated and alignment of the sheet S1 in the conveyance direction is performed.

Figure 17:
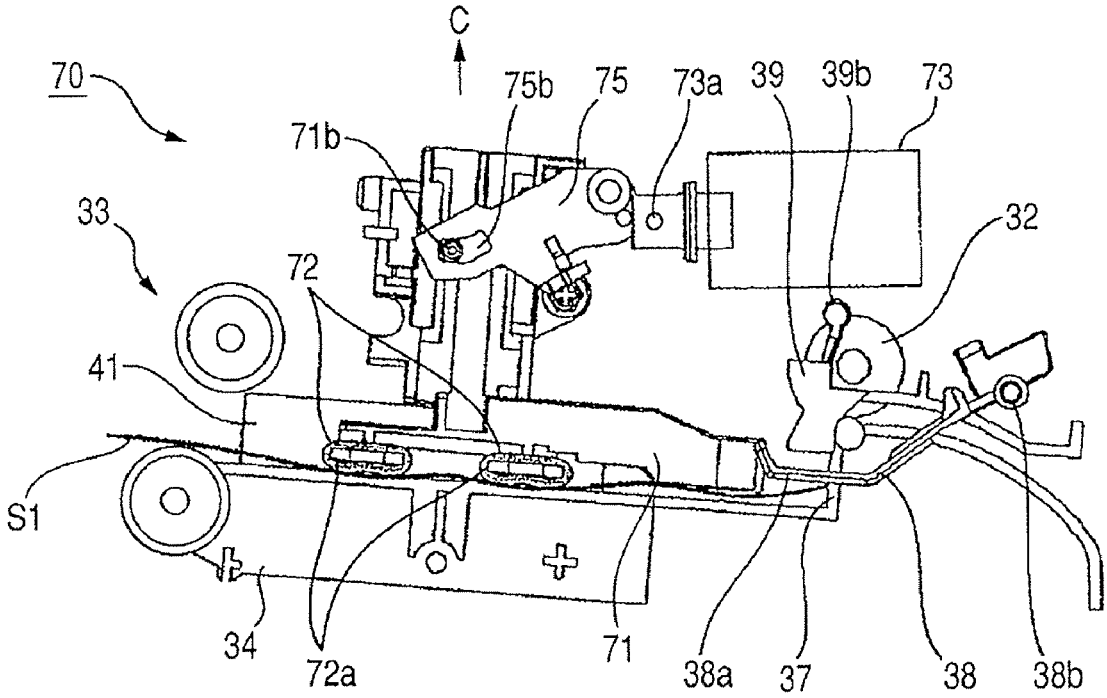
FIG. 17 is a fourth illustration for describing the sheet pressing operation of the pressing unit.

Moreover, after alignments in the width direction and conveyance direction of the sheet S1 are completed, the solenoid 73 operates. Thereby, the pressing member 72 moves integrally with the regulation member 71 in the direction of the arrow Q shown in FIG. 6 and moves to the pressing position for pressing the top of the aligned sheet S1 close to the side end of the sheet S1 as shown in FIG. 17 described later.

In this case, by pressing the side end of the precedent sheet S1 by the pressing member 71, it is possible to securely convey and stack the subsequent sheet S2 onto the intermediate sheet stack portion 34 without being interrupted by the lift of the rear end of the precedent sheet S1. Moreover, because the precedent sheet S1 is energized by the pressing member 72 set to the regulation member 71, shift is not generated due to the friction with the subsequent sheet S2.

However, the subsequent sheet S2 conveyed to the intermediate sheet stack portion 34 is thereafter aligned by the first to third joggers 40*a* to 40*c* and the regulation member 71 moves in the direction of the arrow P in FIG. 6 in order to accept the sheet.

As a result, the regulation member 71 moves to the upper portion of the stacking face 34*a* of the intermediate sheet stack portion 34 as shown in FIG. 5 and the subsequent sheet S2 does not collide with the regulation member 71 or pressing member 72. Then, the above operation is repeated until reaching a predetermined number of sheets to be stapled.

Hereafter, when alignment of the final sheet is completed, the first and third joggers 40*a* and 40*c* are moved to a position for making the first and third joggers 40*a* and 40*c* contact with the sheet end and completely aligned to drive the stapler 42 serving as a binding unit and staple sheets. Finally, the first and second joggers 40*a* and 40*b* shown in FIG. 4 are completely refracted up to positions in which underside is wider than the width of a sheet and a sheet bundle is conveyed by contacting the discharging roller 33 and thereby, the sheet bundle is discharged to and stacked on a stacking tray 35.

Then, the sheet pressing operation by the pressing unit 70 is described below.

For example, before a sheet is conveyed to the intermediate sheet stack portion 34, the regulation member 71 is present at a separate position as shown in FIG. 5 described above. In this case, there is a predetermined gap between the underside 72*a* constituting the pressing face of he pressing member 72 for pressing a sheet and the sheet stacking face 34*a* of the intermediate sheet stack portion 34.

Figure 14:
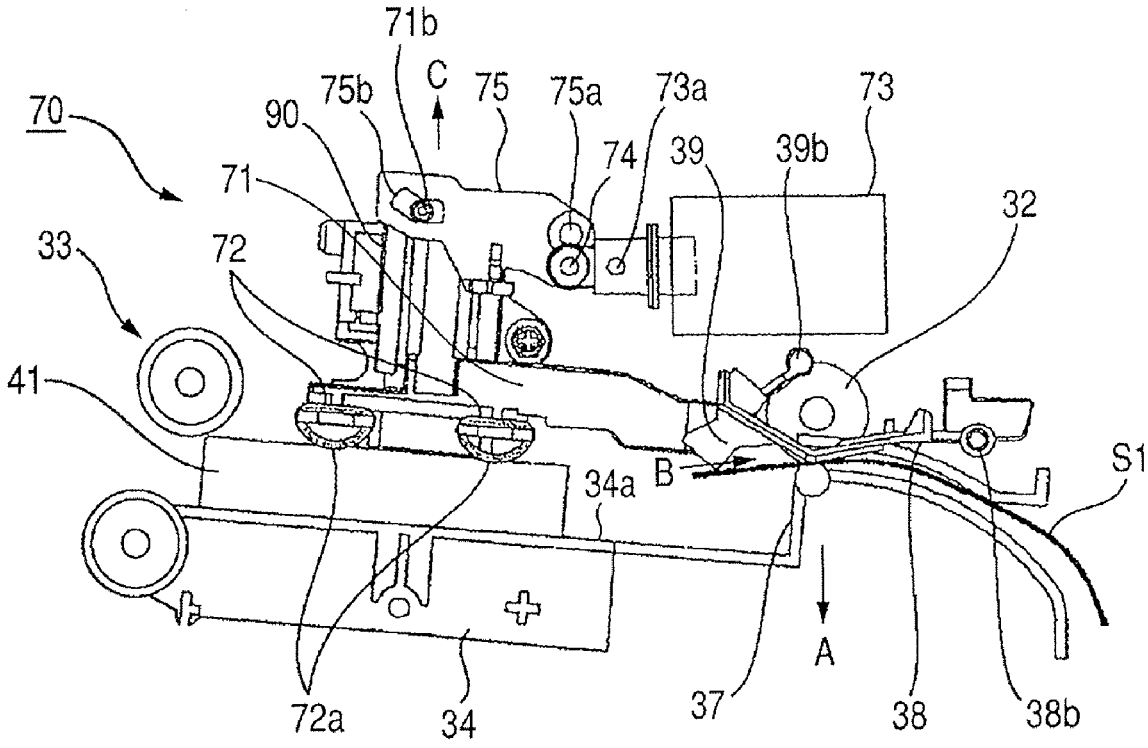
FIG. 14 is a first illustration for describing the sheet pressing operation of the pressing unit of third embodiment of the present invention.

Moreover, when the sheet S1 is conveyed from the above state and the sheet S1 collides with the first pressing member 38 and second pressing member 39, the first pressing member 38 and second pressing member 39 rotate by being pressed by the sheet S1 as shown in FIG. 14.

Figure 15A:
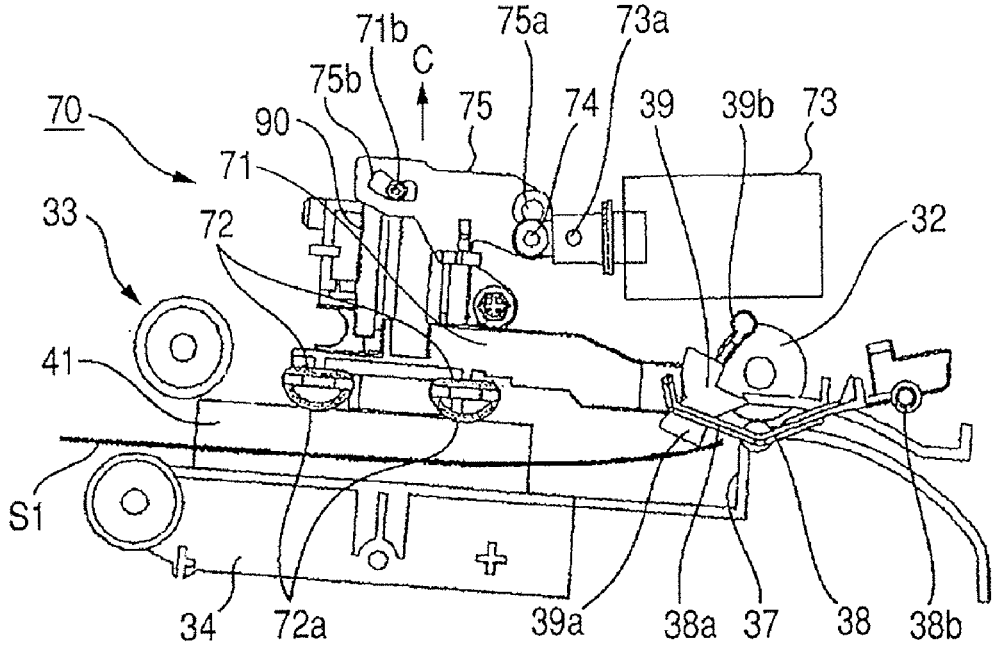
FIGS. 15A and 15B are second illustrations for describing the sheet pressing operation of the above pressing unit.

Hereafter, when the sheet S1 is further conveyed and the rear end of the sheet S1 passes through the intermediate conveying roller 32, the rear end of the sheet S1 is dropped to the intermediate sheet stack portion side by the first pressing unit 38 and second pressing unit 39 as shown in FIG. 15A.

Figure 15B:
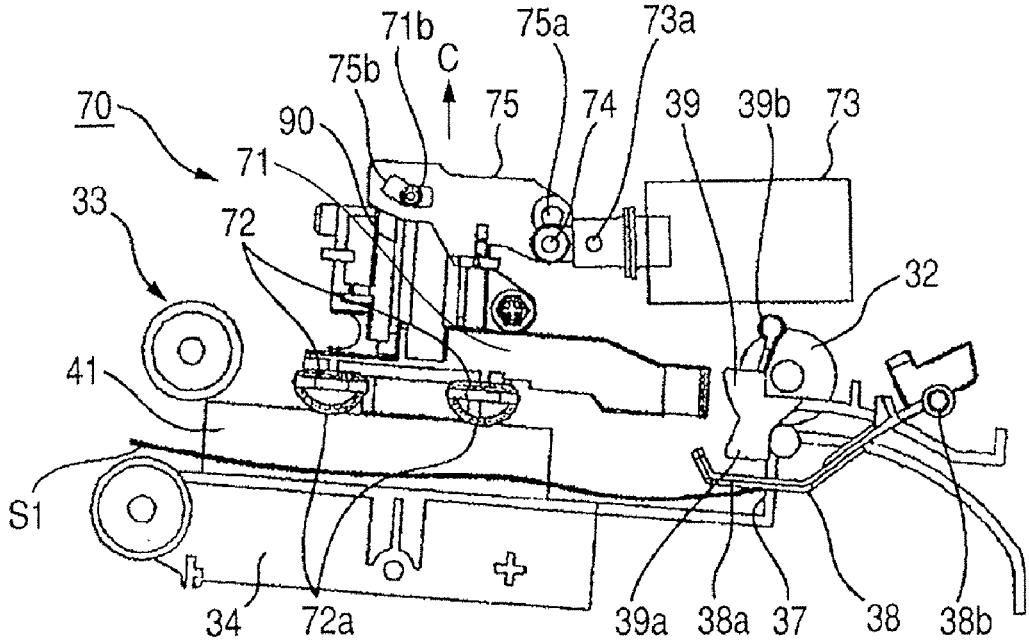

Moreover, when the sheet S1 is further conveyed, the first pressing unit 38 and second pressing unit 39 completely lower as shown in FIG. 15B and lift of the rear end of the sheet S1 is regulated by the first pressing unit 38 and second pressing unit 39. Then, as described for aligning sequence, alignment by the first to third joggers 40*a* to 40*c* and aligning roller 36 is applied to the sheet.

Figure 16:
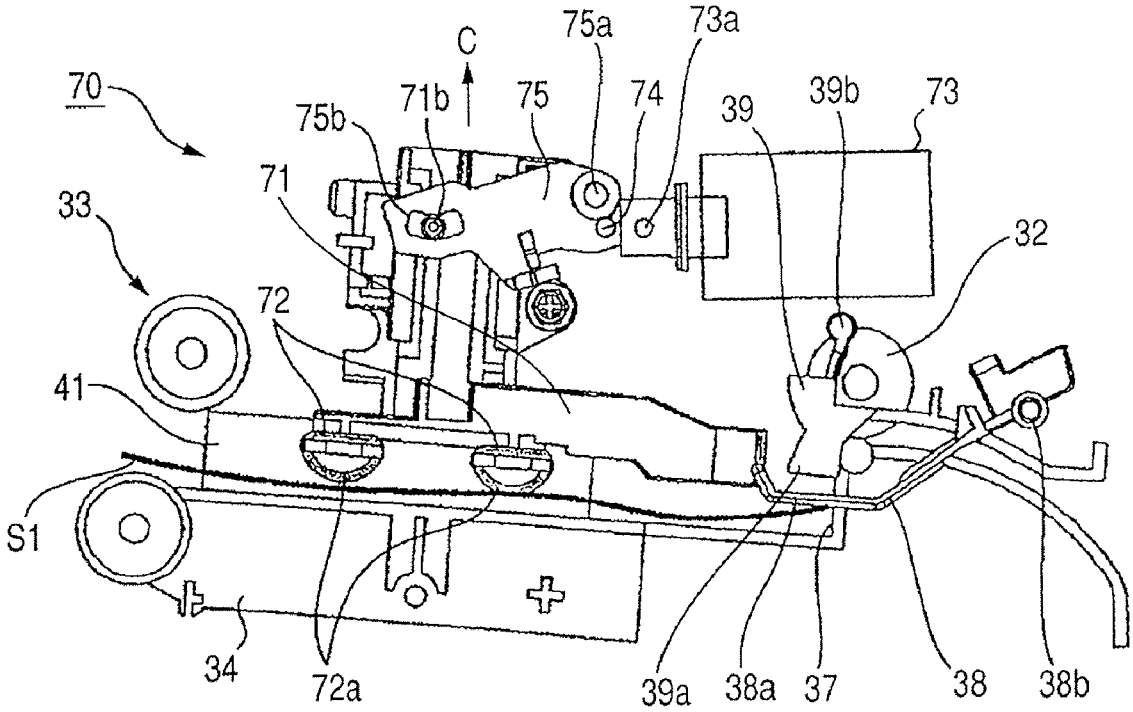
FIG. 16 is a third illustration for describing the sheet pressing operation of the pressing unit.

Then, when alignment by the joggers 40*a* to 40*c* and aligning roller 36 is completed, the solenoid 73 is first turned on and the link member 75 rotates counterclockwise through the pin 73*a* and joint 74 as shown in FIG. 16. Then, the regulation member 71 connected to the link member 75 through the boss 71*b* and cam hole 75*b* starts lowering and a part (front end) of the underside 72*a* of the pressing member 72 contacts with the sheet S1 before long.

Then, because the pressing member 72 is constituted of an almost-elliptic elastic body having a hollow portion as already described, when the regulation member 71 further lowers, the pressing member 72 pressure-contacts with the sheet S1 while it is slowly crushed.

In this case, when a part of the pressing member 72 contacts with the sheet S1 and then it is pressed against the sheet S1 while slowly crushing, the sound when the pressing member 72 contacts with the sheet S1 becomes small. That is, like the case of this embodiment, when constituting the pressing member 72 with an almost-elliptic elastic body having a hollow portion so that it pressure-contacts with the sheet S1 while slowly crushing after a part of the member 72 contacts, it is possible to reduce the intensity of sound when the pressing member 72 contacts with the sheet S1.

Then, when lowering of the regulation member 71 is completed, the pressing member 72 pressure-contacts with the sheet S1 while it is elastically deformed as shown in FIG. 17. In this case, when the pressing member 72 pressure-contacts with the sheet S1 while deforming, it is possible to absorb contact irregularity with the sheet S1 even when the regulation member 71 slightly tilts or the sheet S1 has contact irregularity.

That is, when the pressing member 72 is elastically pressed against the sheet S1, the pressing member 72 can face-contact with the sheet S1 and thereby, it is possible to press the sheet S1 with the same-magnitude pressure.

Moreover, as already described, the pressing member 72 is provided at two places integrally with the regulation member 71. Thus when the pressing member 72 is used at two places, it is possible to press the sheet at two places of T1 and T2 which are shown in FIG. 18. Therefore, even if the subsequent sheet S2 is conveyed and the rotation-directional extrusion force shown by the arrow T3 is added by the subsequent sheet S2, it is possible to stably press the sheet S1 without rotating it.

Thus by constituting the pressing member 72 so that a part of the member 72 contacts with the sheet S1 and then elastically face-contacts with the sheet S1, along with movement of the regulation member 71 to a pressing position, it is possible to securely press the aligned sheet S1. Moreover, it is possible to reduce the sound when pressing the sheet S1.

Moreover, by constituting the sheet pressing unit 70 so as to vertically move as in this embodiment, it is possible to reduce a setting space compared to the case of a conventional example for moving a sheet pressing unit in a circular arc trajectory and downsize the whole apparatus.

Then, fourth embodiment of the present invention is described below.

Figure 19:
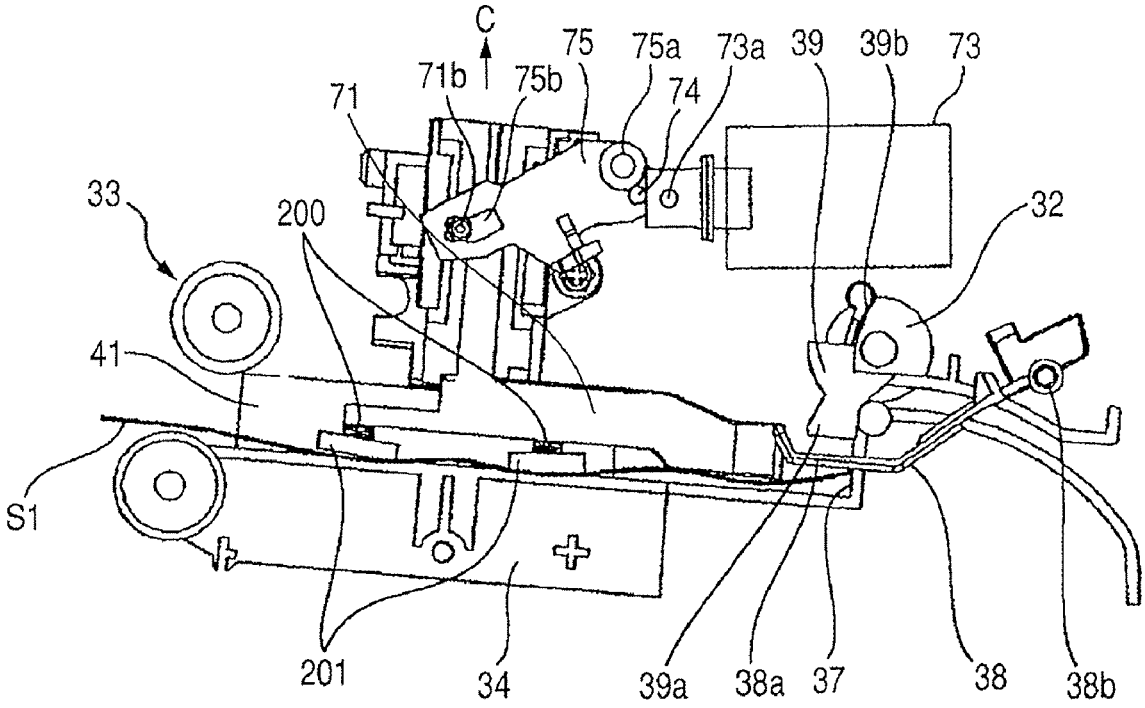
FIG. 19 is an illustration showing the schematic configuration of an intermediate sheet stack portion set to the sheet processing apparatus of a fourth embodiment of the present invention.

FIG. 19 is an illustration showing the configuration of the sheet processing apparatus of this embodiment. In FIG. 19, a symbol same as that in FIG. 5 already described shows the same or equivalent portion.

In FIG. 19, a pressing member 201 is set to the regulation member 71 through an elastic joint member 200 serving as an elastic member such as a spring. Then, by setting the pressing member 201 through the elastic joint member 200 like this, the pressing member 201 can move in accordance with the sheet S1.

Thereby, it is possible that the pressing member 201 can press the sheet S1 with a stable force without one-way contact even when, for example, the regulation member 71 slightly tilts or the aligned sheets have irregularity.

Moreover, because the sheet S1 is pressed at two places in the case of this embodiment, it is possible to stably press the sheet S1 without rotating it. Furthermore, by using this suspension structure, it is possible to reduce the intensity of the sound generated at the time of contact.

Then, the fourth embodiment of the present invention is described below.

Figure 20:
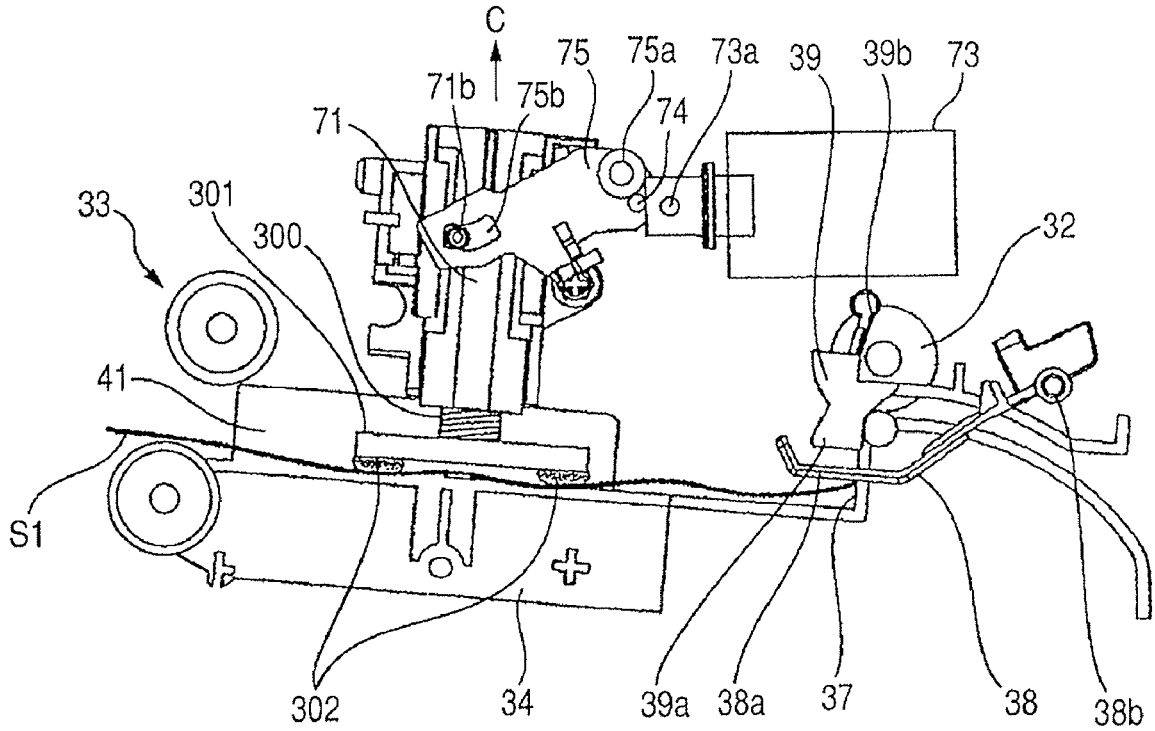
FIG. 20 is an illustration showing the schematic configuration of an intermediate sheet stack portion set to the sheet processing apparatus of a fifth embodiment of the present invention.
Figure 21:
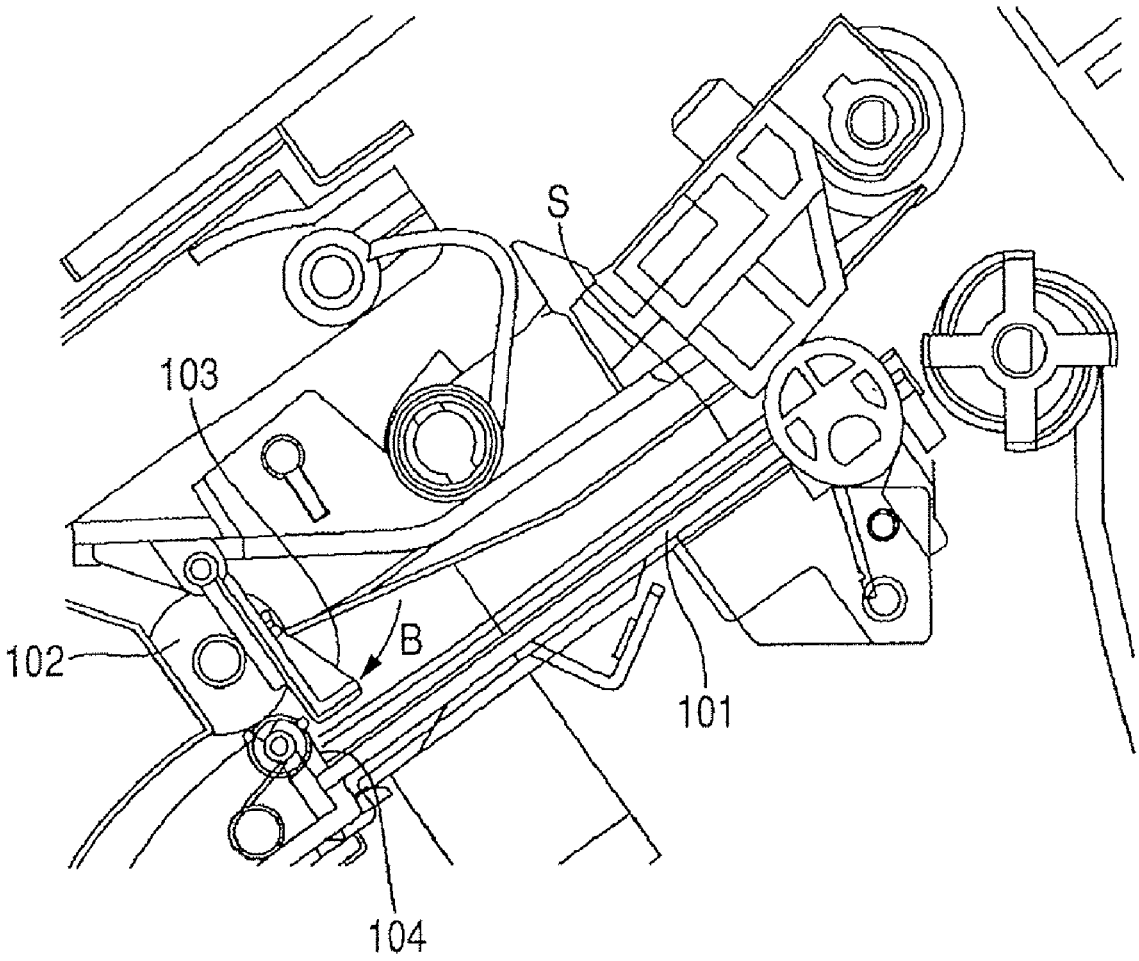
FIG. 21 is an illustration for describing the configuration of a conventional sheet processing apparatus.
Figure 22:
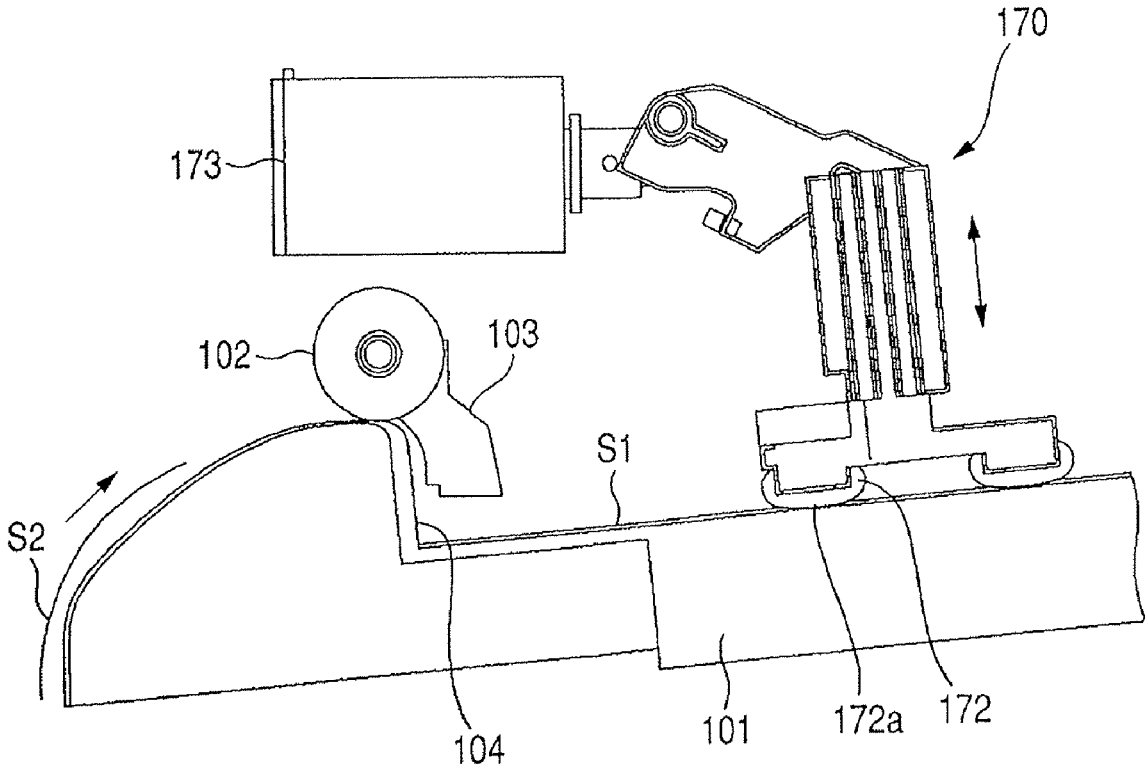
FIG. 22 is an illustration for describing the configuration of an intermediate sheet stack portion set to a conventional sheet processing apparatus.
Figure 23:
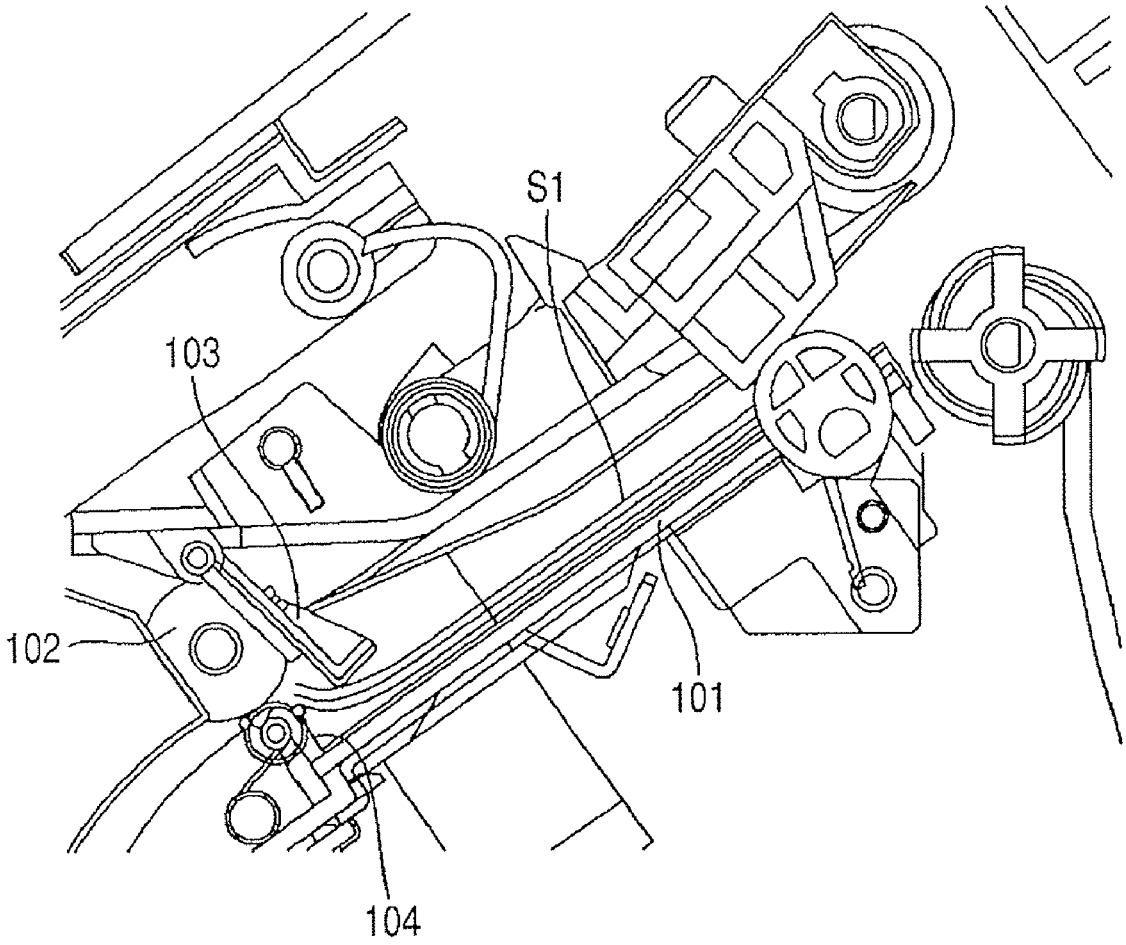
FIG. 23 is an illustration for describing a state when a conventional sheet processing apparatus aligns the rear end position of a sheet whose rear end is curled.
Figure 24:
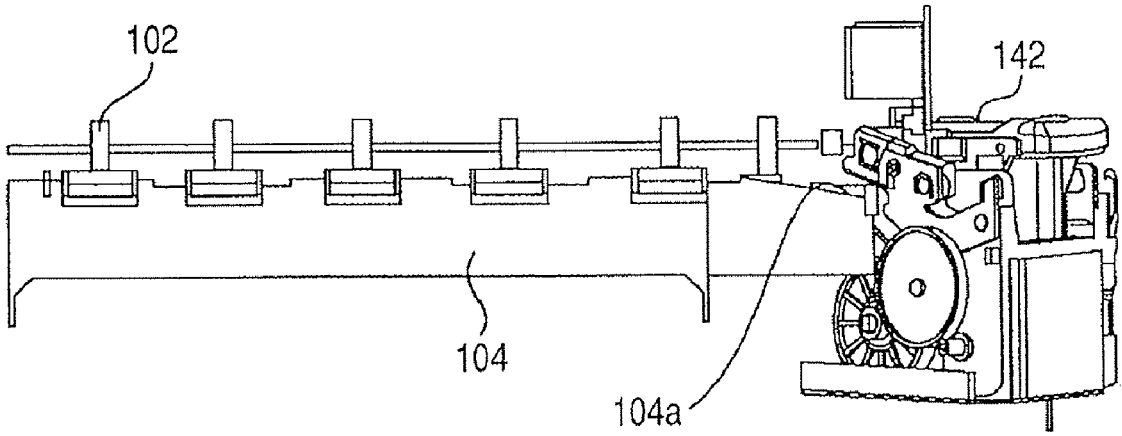
FIG. 24 is a front view of the intermediate sheet stack portion of a conventional sheet processing apparatus.
Figure 25:
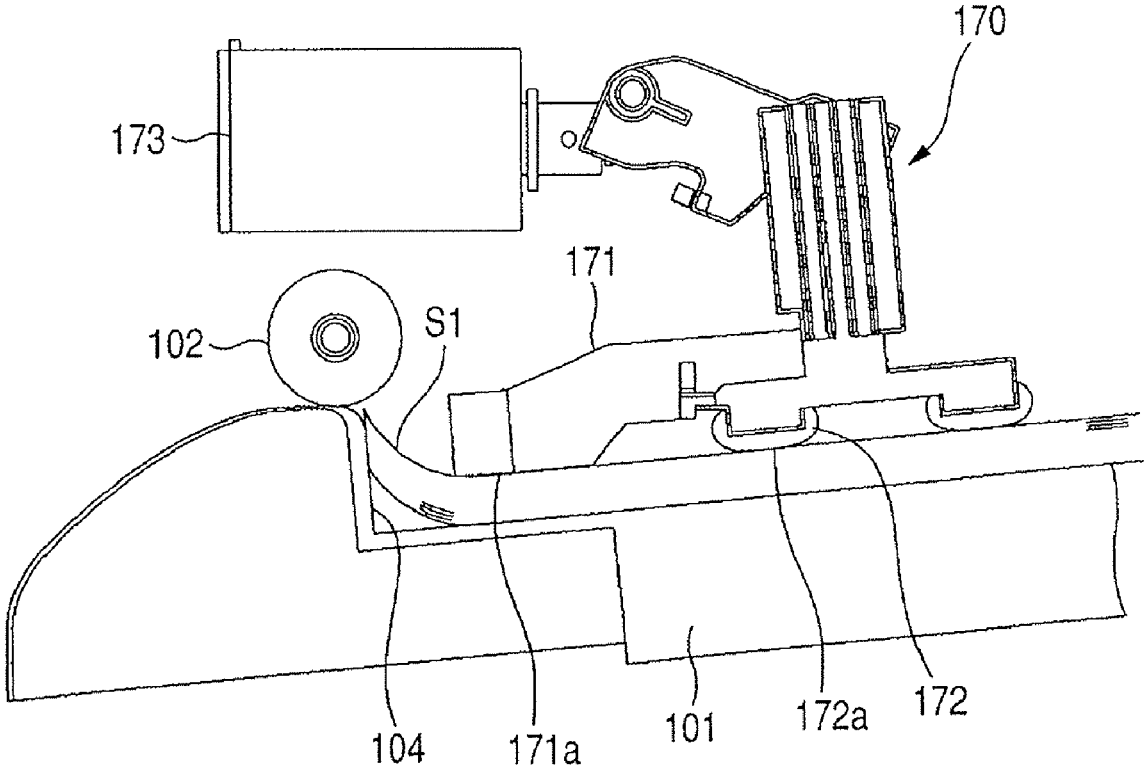
FIG. 25 is an illustration for describing another configuration of an intermediate sheet stack portion set to a conventional sheet processing apparatus.

FIG. 20 is an illustration showing the configuration of the sheet processing apparatus of this embodiment. In FIG. 20, a symbol same as that in FIG. 5 already described shows the same or equivalent portion.

In FIG. 20, a pressing member 302 is held by a lower regulation member 301 serving as a holding member. The lower regulation member 301 is set to the regulation member 71 through an elastic joint member 300 serving as an elastic member such as a spring. That is, in this embodiment, the pressing member 302 is set to the regulation member 71 through the lower regulation member 301 and elastic joint member 300.

Then, by setting the pressing member 302 to the regulation member 71 through the lower regulation member 301 and elastic joint member 300, the pressing member 302 can move in accordance with the sheet S1. Thereby, it is possible that the pressing member 302 can press the sheet S1 with a stable force without one-way contact even when the regulation member 71 slightly tilts or the sheet S1 has irregularity.

Moreover, also this embodiment, it is possible to stably press the sheet S1 without rotating it because of pressing the sheet S1 at two places. Furthermore, by using this suspension structure, it is possible to reduce the intensity of the sound generated at the time of contact.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2006-096436, filed Mar. 31, 2006, and No. 2006-096438, filed Mar. 31, 2006, which are hereby incorporated by reference herein in their entirety.

What is claimed is:

1. A sheet processing apparatus comprising:

a sheet stack portion onto which a sheet to be processed is stacked;

a sheet conveying portion which conveys a sheet to the sheet stack portion;

an aligning portion which aligns the sheet conveyed to the sheet stack portion;

a pressing portion having a pressure-contact face, configured to move between a retracting position where an alignment of the sheet by the aligning portion is not prevented and a pressing position where the aligned sheet is pressed against a stacking surface of the sheet stack portion by the pressure-contact face; and a regulation portion having a regulation surface, configured to move between a retracting position where alignment of the sheet by the aligning portion is not prevented and a regulating position where an upward movement of an end closer to the sheet conveying portion of the aligned sheet in a conveyance direction is regulated by the regulation surface, wherein the regulation portion moves to the regulating position in association with a movement of the pressing portion such that the regulation portion moves to the regulating position from the retracting position when the pressing portion moves to the pressing position from the retracting position.

2. A sheet processing apparatus according to claim 1, wherein the regulation surface of the regulation portion at the regulating position is located above the pressure-contact face of the pressing portion to be pressed against the aligned sheet.

3. A sheet processing apparatus according to claim 1, wherein the regulation surface of the regulation portion at the regulating position can elastically move upward along with a lift of the end of the sheet.

4. A sheet processing apparatus according to claim 1, further comprising:

a binding unit which binds sheets aligned by the aligning portion, wherein the regulation surface is provided closer to the binding position of the binding unit than the pressure-contact face.

5. A sheet processing apparatus according to claim 1, wherein the regulation portion at the pressing portion are provided outside a sheet conveying region in which a sheet is conveyed by the sheet conveying portion.

6. A sheet processing apparatus according to claim 1, wherein the aligning portion has a first aligning portion which aligns an end of a sheet conveyed to the sheet stack portion in the conveyance direction and a second aligning portion which aligns an end of the sheet conveyed to the sheet stack portion in a direction orthogonal to the conveyance direction.

7. A sheet processing apparatus according to claim 6, wherein the regulation portion is provided along the aligning position of the first aligning portion and the regulation surface of the regulation portion is provided closer to the binding unit than the pressing portion.

8. A sheet processing apparatus according to claim 1, comprising:

a driving unit which integrally moves the regulation portion and the pressing portion to a retracting position.

9. A sheet processing apparatus according to claim 1, wherein the regulation portion and the pressing portion are provided integrally.

10. A sheet processing apparatus according to claim 1, wherein the pressing portion is constituted of an elastic body having a hollow portion and at least a part of the pressing portion contacts with the aligned sheet and then the pressing portion is elastically pressed against the sheet in a face contact state.

11. A sheet processing apparatus according to claim 1, wherein the pressing portion is set with an elastic member in-between.

12. A sheet processing apparatus according to claim 1, comprising:

a holding member which holds the pressing portion, wherein the holding member is set with an elastic member in-between.

13. A sheet processing apparatus according to claim 1, wherein a plurality of the pressing portions are provided along the conveyance direction.

14. A sheet processing apparatus according to claim 1, wherein the pressing portion and the regulation portion move substantially vertically with regard to the aligned sheet.

15. A sheet processing apparatus according to claim 1, comprising:

a pressing unit which includes a main body provided with the regulation portion and the pressing portion.

16. An image forming apparatus comprising:

an image forming portion which forms an image; and a sheet processing apparatus which processes a sheet on which an image is formed by the image forming portion, wherein the sheet processing apparatus includes:

a sheet stack portion onto which a sheet to be processed is stacked;

a sheet conveying portion which conveys a sheet to the sheet stack portion;

an aligning portion which aligns the sheet conveyed to the sheet stack portion;

a pressing portion having a pressure-contact face, configured to move between a retracting position where an alignment of the sheet by the aligning portion is not prevented and a pressing position where the aligned sheet is pressed against a stacking surface of the sheet stack portion by the pressure-contact face; and a regulation portion having a regulation surface, configured to move between a retracting position where alignment of the sheet by the aligning portion is not prevented and a regulating position where an upward movement of an end closer to the sheet conveying portion of the aligned sheet in a conveyance direction is regulated by the regulation surface, wherein the regulation portion moves to the regulating position in association with a movement of the pressing portion such that the regulation portion moves to the regulating position from the retracting position when the pressing portion moves to the pressing position from the retracting position.

17. An image forming apparatus according to claim 16, wherein the pressing portion presses the aligned sheet while a subsequent sheet is conveyed by the sheet conveying portion.

18. An image forming apparatus according to claim 16, wherein the regulation surface of the regulation portion at the regulating position is located above the pressure-contact face of the pressing portion pressed against a sheet.

19. An image forming apparatus according to claim 16, wherein the regulation surface of the regulation portion at the regulating position can be elastically moved upward by the lift of the end of the sheet.

20. An image forming apparatus according to claim 16, wherein the pressing portion is constituted of an elastic body having a hollow portion and at least a part of the pressing portion contacts with the aligned sheet and then the pressing portion is pressed against the sheet in a face contact state.

21. An image forming apparatus according to claim 16, wherein a plurality of pressing portions are provided along the conveyance direction.

22. An image forming apparatus according to claim 16, wherein the regulation portion and the pressing portion are provided outside a sheet conveying region in which a sheet is conveyed by the sheet conveying portion.

23. An image forming apparatus according to claim 16, comprising:

a pressing unit which includes a main body provided with the regulation portion and the pressing portion.

* * * * *